US009377708B2

(12) United States Patent
Magome et al.

(10) Patent No.: US 9,377,708 B2
(45) Date of Patent: Jun. 28, 2016

(54) TONER

(71) Applicant: CANON KABUSHIKI KAISHA, Tokyo (JP)

(72) Inventors: Michihisa Magome, Mishima (JP); Tomohisa Sano, Mishima (JP); Kozue Uratani, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 20 days.

(21) Appl. No.: 14/476,325

(22) Filed: Sep. 3, 2014

(65) Prior Publication Data

US 2015/0064617 A1 Mar. 5, 2015

(30) Foreign Application Priority Data

Sep. 5, 2013 (JP) ..... 2013-183593

(51) Int. Cl.
*G03G 9/087* (2006.01)
*G03G 9/093* (2006.01)

(52) U.S. Cl.
CPC ..... *G03G 9/08782* (2013.01); *G03G 9/08797* (2013.01); *G03G 9/09328* (2013.01); *G03G 9/09364* (2013.01)

(58) Field of Classification Search
CPC ..... G03G 9/08755; G03G 9/087872; G03G 9/09733; G03G 9/08797
USPC ..... 430/108.4
See application file for complete search history.

(56) References Cited

U.S. PATENT DOCUMENTS 5,741,617 A 4/1998 Inaba et al.
5,998,080 A * 12/1999 Ohno ..... G03G 9/0806 430/110.4
7,364,827 B2 4/2008 Ueda et al.
7,572,564 B2 * 8/2009 Sato ..... G03G 9/0806 430/108.4
7,923,190 B2 4/2011 Magome et al.
8,361,688 B2 * 1/2013 Kouyama ..... G03G 9/08782 430/108.4
8,426,094 B2 4/2013 Magome et al.
8,614,044 B2 12/2013 Matsui et al.
8,778,585 B2 * 7/2014 Matsui ..... G03G 9/0806 430/108.4
2006/0172211 A1 * 8/2006 Ueda ..... G03G 9/0806 430/108.4
2009/0035681 A1 * 2/2009 Yuasa ..... G03G 9/0804 430/108.4
2009/0035682 A1 * 2/2009 Shima ..... G03G 9/0804 430/108.4
2009/0233203 A1 * 9/2009 Yuasa ..... G03G 9/0806 430/108.4
2013/0164669 A1 * 6/2013 Yamashita ..... C08G 63/916 430/108.4

FOREIGN PATENT DOCUMENTS

JP 8-50367 A 2/1996
JP 11-133657 A 5/1999
JP 2006-243714 A 9/2006
JP 2007-193253 A 8/2007

OTHER PUBLICATIONS

U.S. Appl. No. 14/573,375, filed Dec. 17, 2014. Inventor: Ito, et al.
U.S. Appl. No. 14/571,683, filed Dec. 16, 2014. Inventor: Wakabayashi, et al.
U.S. Appl. No. 14/568,058, filed Dec. 11, 2014. Inventor: Matsui, et al.
U.S. Appl. No. 14/568,062, filed Dec. 11, 2014. Inventor: Magome, et al.
U.S. Appl. No. 14/571,167, filed Dec. 15, 2014. Inventor: Matsui, et al.
U.S. Appl. No. 14/568,061, filed Dec. 11, 2014. Inventor: Magome, et al.

* cited by examiner

*Primary Examiner* — Christopher D Rodee
(74) *Attorney, Agent, or Firm* — Fitzpatrick, Cella, Harper and Scinto

(57) ABSTRACT

A toner has toner particles including a binder resin, a colorant, an ester wax and a hydrocarbon wax; and inorganic fine particles. The ester wax includes an ester compound having a structure represented by formula (1): $R_1$—CO—O—$(CH_2)_x$—O—OC—$R_2$; or formula (2): $R_3$—O—OC—$(CH_2)_x$—CO—O—$R_4$. The ester wax includes an ester compound having a highest abundance rate in an amount of 40% to 80% by mass with respect to a total amount of the ester wax in a composition distribution. The ester wax has, in differential scanning calorimetry, a peak top temperature of an endothermic peak of 65° C. to 80° C. In differential scanning calorimetry, the toner has only one endothermic peak derived from the waxes. A relationship: $3.0 \leq (Tw-Tt) \leq 8.0$ is satisfied.

6 Claims, 1 Drawing Sheet

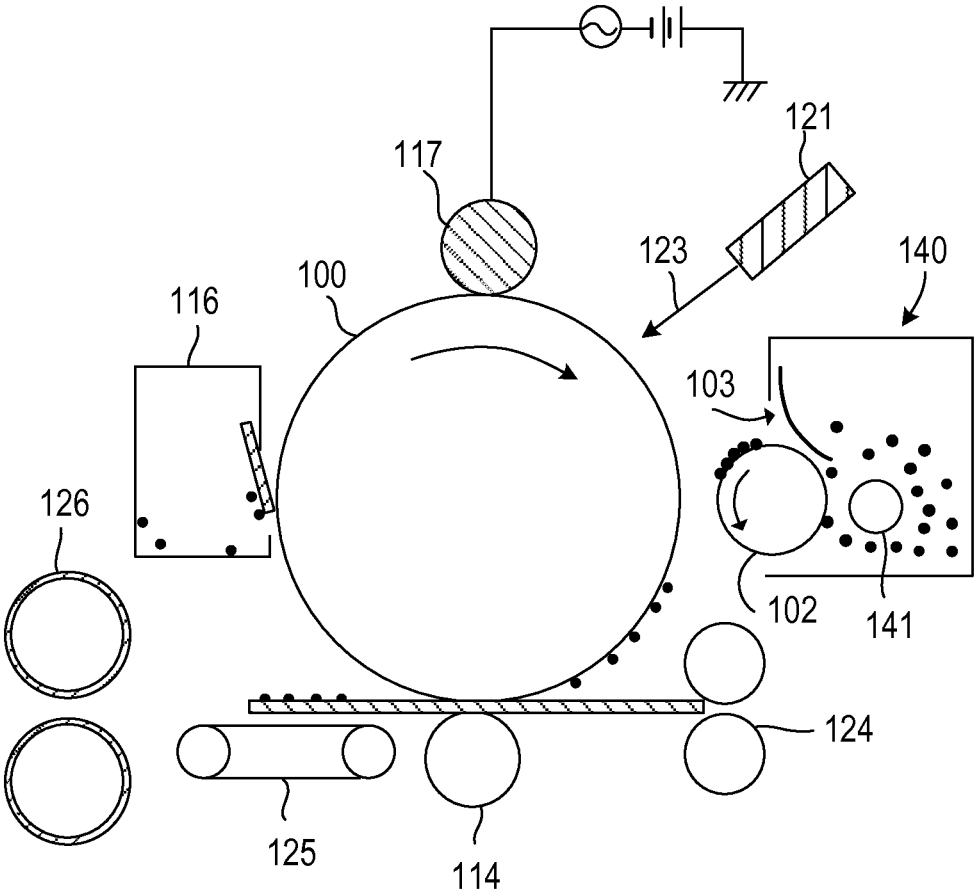
117
121
123
140
100
116
103
126
102
141
124
125
114

TONER

BACKGROUND OF THE INVENTION

1. Field of the Invention

The present invention relates to a toner used in a recording method utilizing electrophotography or the like.

2. Description of the Related Art

A large number of methods for electrophotography are known. An electrostatic latent image is formed on an electrostatic image bearing member (hereinafter, also referred to as "photosensitive member") by generally utilizing a photoconductive substance and using various types of apparatus units. The latent image is then developed with a toner and made to be a visible image; and the resulting toner image is transferred on a recording medium such as paper as needed, and thereafter fixed on the recording medium by heat, pressure or the like to thereby obtain a copy. Image forming apparatuses using such electrophotography include copying machines and printers.

Shift from analog to digital is occurring in these printers and copying machines, and the image quality is demanded which is excellent in reproducibility of latent images and is of a high resolution while being stable also in long-term use. A toner good in fixing property is further demanded as an energy saving measure, and for the improvement in the fixing property, the improvement in a binder resin, the improvement in a wax and the like are being carried out.

Here, paying attention to a wax, it is generally known that the use of a wax in a large amount decreases the viscosity of a toner when it is melted and makes the fixing property of the toner good. The use of the wax in a large amount, however, is liable to make the durability and the preservability of the toner inferior, so the simultaneous satisfaction of the both has been attempted conventionally by adjusting the balance between the fixing property, and the durability or preservability.

Even in the range of simultaneously satisfying the both, however, a new bad effect on images such as the image density thinness or weakness at image ends comes to occur.

The density thinness at both ends of images occurs as follows. Many printers form electrostatic latent images on a photosensitive member surface by a laser using a scanner. Inside the scanner, the electrostatic latent image is formed by a polygon mirror rotating at a high speed, but the potentials at both ends of the electrostatic latent images drop due to a part of the polygon mirror being contaminated and the developing contrast is reduced to thereby cause the density thinness at both ends of the images.

An analysis of the contamination of the polygon mirror revealed that the contamination is caused by a wax component of a toner. It is known that whereas the wax oozes out in the fixing time of the toner and exhibits the release property from a fixing member, a part of the wax is volatilized. On the other hand, since the polygon mirror in the scanner interior rotates at a high speed, the scanner interior pressure becomes negative and the scanner interior is liable to draw in surrounding air. A part of the wax component volatilized and solidified is then drawn in the scanner interior and a part of the wax component deposits on the polygon mirror to thereby resultantly cause the density thinness at both ends of images as described above.

Many types of toners are proposed for the improvement in the fixing property, and in many cases a combination of two waxes (see Japanese Patent Application Laid-Open Nos. H08-050367 and 2006-243714), or a wax having a special composition (see Japanese Patent Application Laid-Open Nos. H11-133657 and 2007-193253) is used. However, although an improvement in the fixing property by the use of these proposed waxes is recognized, the waxes are insufficient for the density thinness at both ends of images caused by the polygon mirror contamination, and an improvement is demanded.

SUMMARY OF THE INVENTION

It is an object of the present invention to provide a toner that has a good preservability and fixing property, and exhibits no density thinness or weakness at both ends of images even in long-term use.

The present invention provides a toner having toner particles, each of which includes a binder resin, a colorant, an ester wax and a hydrocarbon wax; and inorganic fine particles, wherein: the ester wax includes an ester compound having a structure represented by the following formula (1) or (2): Formula (1): $R_1—CO—O—(CH_2)_x—O—OC—R_2$; or Formula (2): $R_3—O—OC—(CH_2)_x—CO—O—R_4$ wherein $R_1$ to $R_4$ are an alkyl group; and x is an integer of 8 to 10; the ester wax includes, in a composition distribution, an ester compound having a highest abundance rate in an amount of 40% by mass or higher and 80% by mass or lower with respect to the total amount of the ester wax; when measuring the ester wax and the hydrocarbon wax solely with differential scanning calorimetry, each of the waxes has an endothermic peak respectively, the endothermic peak of the ester wax having a peak top temperature of 65° C. to 80° C., and when measuring the toner with differential scanning calorimetry, the toner has only one endothermic peak derived from the waxes, the only one endothermic peak having a peak top temperature Tt (° C.), wherein: when, out of peak top temperatures of the endothermic peak of the ester wax and the endothermic peak of the hydrocarbon wax, the lower temperature is defined as Tt (° C.), Tt (° C.) and Tt (° C.) satisfy the following relationship: $3.0 \leq (Tw-Tt) \leq 8.0$.

The present invention enables providing a toner that has a good preservability and fixing property, and exhibits no density thinness at both ends of images even in long-term use.

Further features of the present invention will become apparent from the following description of exemplary embodiments with reference to the attached drawing.

BRIEF DESCRIPTION OF THE DRAWING

FIGURE is a schematic cross-sectional view illustrating one example of an image forming apparatus capable of suitably using the toner according to the present invention.

DESCRIPTION OF THE EMBODIMENTS

Preferred embodiments of the present invention will now be described in detail in accordance with the accompanying drawing.

As a result of exhaustive studies by the inventors, the density thinness or weakness at both ends of images can be largely improved and a good fixing property can further be provided by using a specified ester wax and a specified hydrocarbon wax; and these findings have led to the present invention.

First, the density thinness at both ends of images has been studied in detail, and it is important that the amount of the wax component volatilized is suppressed and the particle diameter when the volatilized wax component is solidified is controlled. Specifically, the volatilized wax component is solidified, but the wax component having a larger solidified particle diameter more hardly scatters to a scanner; and the amount of the wax component taken in the scanner interior is resultantly decreased, so that the density thinness at both ends of images can be suppressed.

This phenomenon has been variously studied; and it is important that: i) a toner containing a specified ester wax and a specified hydrocarbon wax is used, and the toner has only one endothermic peak derived from a wax in differential scanning calorimetry (DSC); and ii) a relationship: $3.0 \leq (Tw-Tt) \leq 8.0$ is satisfied where Tt (° C.) represents a peak top temperature of the only one endothermic peak derived from the waxes, and out of peak top temperatures of the endothermic peak of the ester wax and the endothermic peak of the hydrocarbon wax, the lower temperature is defined as Tw (° C.).

In the case where two or more waxes are used in a combination, it is usual that the both codissolve or are separated into layers. In the former case, an endothermic peak of the wax emerges between endothermic peaks of the two waxes according to the mixing proportion of the two waxes. On the other hand, in the latter case of the layer separation state, even if two waxes are mixed, respective peaks of the waxes are observed.

By contrast, the toner according to the present invention is neither of the both, and has an endothermic peak on the lower-temperature side by 3° C. or more than an endothermic peak on the lower-temperature side out of endothermic peaks of an ester wax and a hydrocarbon wax used in the present invention. This implies that a combined use of two waxes causes a melting point lowering of the wax.

Combinations of waxes causing such a melting point lowering, and amounts of wax components volatilized have been examined, and it is found that in a system lowered in the melting point, the amount of a wax component volatilized is reduced. With respect to the reason therefor, the inventors believe as follows.

The free energy change of a system is generally represented by the following formula (3) from the formula of Gibbs free energy.

$$\Delta G = \Delta H - T\Delta S \quad \text{(Formula 3)}$$

wherein G is a free energy; H is an enthalpy; T is a temperature; and S is an entropy.

Since $\Delta G=0$ at a melting point (Tm) at which a crystal melts, Formula (3) leads to the following:

$$Tm = \Delta H / \Delta S \quad \text{(Formula 4)}$$

The lowering of the melting point is caused as described above in the present invention, and that the melting point lowers implies in Formula (4) that a decrease in ΔH, an increase in ΔS, or the both are caused. The decrease in ΔH means a decrease in the degree of crystallinity of a wax; and the increase in ΔS indicates a state that the disorder of the wax is large, and herein, the wax conceivably takes such a special state as a fine sea-island structure in domains.

In the case where two waxes do not completely codissolve, it is generally said that the waxes have influences on each other at the interface of the waxes, and it is conceivable that such a state as a fine sea-island structure gives a relatively low degree of crystallinity in the vicinity of the wax interface.

In a toner having such a presence state of waxes, it is conceivable that since the waxes melt very fast when the toner receives heat from a fixing assembly in the fixing time, and the amount of the waxes infiltrated into a resin resultantly increases, the amount of the wax component volatilized is reduced.

Then, the inventors' thought on the solidification of the volatilized wax component will be described. The volatilized wax component forms a crystal nucleus first in the solidification process, and the crystal thereafter grows. Describing the process in detail, the activation energy (Gt) of the nucleation is known as the following formula (5) from the theory of the nucleation.

$$Gt = 4\pi R^2\gamma - 4/3\pi R^3 \Delta G \quad \text{Formula (5)}$$

wherein R is a critical nucleus radius; ΔG is a free energy change; and γ is a constant.

Differentiation of this expression with respect to R gives the following formula (6) to R.

$$R = \frac{2\gamma}{\Delta G} \quad \text{Formula (6)}$$

Considering the particle diameter of a solidified substance (solidified volatilized-wax component), it is conceivable that a crystal nucleus largely and slowly grows to become a large crystal to thereby make the particle diameter of the solidified substance large.

Then considering the size of a crystal nucleus, it is conceivable that since the size of a crystal nucleus is proportional to the critical nucleus radius, making the critical nucleus radius large is effective to upsize the particle diameter of a solidified substance.

Returning to Formula (6), it is important that in order to make the critical nucleus radius large, ΔG is made low. ΔG is the above-mentioned Gibbs free energy.

As described before, in the present invention, ΔS at the melting time is large. A melting point is a first-order phase transition from solid to liquid, and the solidification of a volatilized wax component is conceivably a result of continuous first-order phase transitions of gas⇒liquid⇒solid. Hence, it is anticipated that a wax relevant to the present invention exhibits a large ΔS in the first-order phase transition, and it is resultantly conceivable that the critical nucleus radius becomes large.

Then, it is important that in a composition distribution of an ester wax used for the toner according to the present invention, the proportion of an ester compound having a highest abundance rate with respect to the total amount of the ester wax is 40% by mass or higher and 80% by mass or lower. That the proportion of an ester compound having a highest abundance rate in an ester wax with respect to the total amount of the ester wax is 40% by mass or higher and 80% by mass or lower means that the ester wax has a distribution in its composition.

Compositions of ester waxes used for the toner according to the present invention are shown in Table 1 as examples, but the ester waxes have various compositions as shown in Table 1, and it is important that the highest composition proportion is controlled.

Here, considering compositions of ester waxes, it is obvious that the entropy becomes larger in an ester wax having a distribution in its composition than in an ester wax having a single composition, and also here, ΔG of Formula (6) becomes small. It is presumed that the critical nucleus radius becomes larger by a synergetic effect of the contribution of the composition of the ester wax to ΔG and the largeness of ΔS in the first-order phase transition.

Then, paying attention to the crystal growth process, a lower speed of the crystallization generally gives a larger crystal. Here, considering the crystal growth process in the present invention, it is conceivable that a crystal nucleus to become a nucleus of crystal growth is large as described above. On the other hand, it is conceivable that since a distribution of a wax composition becomes a factor of inhibiting crystal growth in the crystal growth, the crystal growth speed becomes lower in a system using an ester wax having a composition distribution as seen in the present invention.

From these considerations, the case where the proportion of an ester compound having a highest abundance rate in an ester wax with respect to the total amount of the ester wax is higher than 80% by mass cannot provide the effect caused by the entropy as described above and resultantly gives a small particle diameter of a solidified substance. As a result, the density thinness at both ends of images occurs, which is not preferable.

The case where the proportion of an ester compound having a highest abundance rate in an ester wax with respect to the total amount of the ester wax is lower than 40% by mass means having a considerably broad composition distribution. Hence, although the above effect can easily be attained, the degree of crystallinity of the wax in a toner is liable to decrease, and the preservability decreases, which are not preferable.

The inventors consider that the synergetic effect of three points of the decrease in volatilized components of a wax due to that the melting point lowering of the wax occurs, the upsizing of the crystal nucleus caused by the largeness of ΔS, and the decrease in the crystal growth speed due to a composition distribution of an ester wax, as described above, largely reduces a wax solidified substance reaching a scanner and enables elimination of the density thinness at both ends of images.

It is important that an ester wax used for the toner according to the present invention has a peak top temperature of an endothermic peak of 65° C. or higher and 80° C. or lower when measuring an ester solely with differential scanning calorimetry (DSC).

If the peak top temperature of the endothermic peak is 65° C. or higher and 80° C. or lower, the ester wax quickly melts at the fixing time and the amount codissolved with a binder resin becomes sufficient. Further, the amount of a wax component volatilized does not become large, and the effect described hitherto can be attained sufficiently.

If the peak top temperature of the endothermic peak of the ester wax is lower than 65° C., the temperature difference between a fixing member and the melting point of the wax becomes too large, and the amount volatilized then increases. By contrast, if the peak top temperature of the endothermic peak is higher than 80° C., although the amount of the wax component volatilized decreases, the crystallization speed when the wax component volatilized solidifies becomes high, and the particle diameter of a solidified substance resultantly becomes small, which is not preferable.

It is important that the toner according to the present invention has only one endothermic peak derived from the waxes (i.e. an ester wax and a hydrocarbon wax) contained in the toner when measuring the toner with differential scanning calorimetry (DSC), and a relationship of $3.0 \leq (Tw-Tt) \leq 8.0$ is satisfied when a peak top temperature of the only one endothermic peak derived from the waxes is defined as Tt (° C.), and out of peak top temperatures of the endothermic peak of the ester wax and the endothermic peak of the hydrocarbon wax, the lower temperature is defined as Tw (° C.).

As described hitherto, in the present invention, the melting point lowering of the wax is very important. Hence, a lowering width of less than 3.0° C. gives an insufficient effect of melting point lowering, which is not preferable. In the case where the lowering width of melting point lowering is more than 8.0° C., ΔH conceivably largely decreases. This means a large decrease of the degree of crystallinity of the wax, and the degradation of the durability and the worsening of the preservability in long-term use are liable to be caused, which is not preferable.

Hence, in the present invention, it is important that the lowering width (that is, Tw−Tt) of the melting point lowering is 3.0° C. or more and 8.0° C. or less, and preferably 3.0° C. or more and 6.0° C. or less.

The lowering width of the melting point lowering can be controlled by a combination of waxes to be used and a method for producing the toner. Specifically, the combination is a combination of an ester wax having a structure of Formula (1) or (2) having a composition distribution, with a hydrocarbon wax. The method for producing the toner can also be controlled in the way that heat is applied when the toner is produced, the cooling speed in the cooling time, and the like.

The toner according to the present invention conceivably has a special presence state of waxes. Hence, for example, if no heat giving the melting point of the waxes or higher is applied, the waxes exert no interaction to each other nor cause a melting point lowering. On the other hand, even in the case where heat giving the melting point of the waxes or higher is applied, if the cooling speed is high, a state like a layer separation is liable to be made and the melting point lowering is hardly caused. Conversely, if the cooling speed is too low, the melting point lowering width is liable to become large to resultantly cause the bad effect as described above. Hence, in the production of the toner according to the present invention, in a production process of the toner, the toner can be heated to a temperature equal to or higher than the melting point of waxes, and in a cooling process thereafter, the cooling speed can be made to be, for example, 0.3° C./min or higher and 3.0° C./min or lower.

An ester wax used for the toner according to the present invention can be such that the total abundance rate of ester compounds having molecular weights of M satisfying:

$$0.8 \times M1 \leq M \leq 1.2 \times M1 \quad \text{(A)}$$

where M1 represents the molecular weight of an ester compound having a highest abundance rate in the ester wax, is preferably 90% by mass or higher with respect to the total amount of the ester wax. Describing this in Table 1, the molecular weight M1 of an ester compound having a highest abundance rate in an ester wax is 819.4. It is clear that components satisfying the above requirement (A) account for 100% by mass.

If components satisfying the above requirement (A) account for 90% by mass or more with respect to the total amount of the ester wax, the particle diameter of a solidified substance becomes large, which is preferable. The inventors consider the reason therefor as follows.

Considering R (critical nucleus radius) of Formula (6), it is generally said that a nucleus smaller than the critical nucleus radius cannot take a stable energy level and disappears. By contrast, it is also known that a nucleus smaller than the critical nucleus radius takes a metastable crystal structure, and the metastable crystal takes a structure covering a nucleus larger than the critical nucleus radius. Taking such a structure makes the critical nucleus radius large.

Here, the inventors consider that if components satisfying the above requirement (A) account for 90% by mass or more with respect to the total amount of the ester wax, the formation of the above-mentioned metastable state progresses very smoothly. The inventors consider that this is because the presence of a suitably resembling substance stabilizes the metastable state, and the formation of the metastable state resultantly progresses and the crystal nucleus becomes large.

In the present invention, a method for controlling a composition distribution of an ester wax includes a method of mixing a number of ester waxes of single compositions, and a method of synthesizing an ester wax by using a raw material having a composition distribution and using the synthesized ester wax.

A hydrocarbon wax used for the toner according to the present invention has an endothermic peak when measuring a hydrocarbon wax solely with differential scanning calorimetry (DSC). And a hydrocarbon wax can have a peak top temperature of an endothermic peak of 70° C. or higher and 85° C. or lower, and a full width at half maximum of the endothermic peak of 5° C. or less.

That the full width at half maximum of the endothermic peak is 5° C. or less means that a molecular weight distribution of the hydrocarbon wax is sharp. As described before, it is very important that an ester wax used in the present invention has a distribution in its composition, and the combined use with a hydrocarbon wax causes a melting point lowering. In addition thereto, with a sharp molecular weight distribution (that is, the full width at half maximum is 5° C. or less) of the hydrocarbon wax, the crystal easily becomes larger when the volatilized wax component is solidified, which is much preferable. The inventors consider that this is because a melting point lowering is caused by using an ester wax having a composition distribution, and a hydrocarbon wax having a sharp molecular weight distribution, and ΔS of the wax becomes larger.

By contrast, also a combination of an ester wax having no composition distribution and a hydrocarbon wax having a molecular weight distribution is conceivable, but this gave a small particle diameter to a solidified substance, and the density thinness at both ends of images could not be improved. The inventors presume that this is because whereas the contribution of the ester wax having a composition distribution to ΔS is large, the contribution of the hydrocarbon wax having a molecular weight distribution to ΔS is small.

As a hydrocarbon wax usable for the toner according to the present invention, every hydrocarbon wax satisfying the above condition can be used. The hydrocarbon wax specifically includes paraffin wax, microcrystalline wax, petroleum-based wax such as petrolactum and derivatives thereof, hydrocarbon wax by Fischer-Tropsch process and derivatives thereof, and polyolefin wax represented by polyethylene and derivatives thereof.

The toner according to the present invention contains, with respect to 100 parts by mass of a binder resin, preferably 5 parts by mass or larger and 40 parts by mass or smaller of the total amount of an ester wax and a hydrocarbon wax, and more preferably 10 parts by mass or larger and 30 parts by mass or smaller thereof. If the content of the wax is 5 parts by mass or larger and 40 parts by mass or smaller, a good fixing property is maintained and the density thinness at both ends of images hardly occurs, which is much preferable.

The toner according to the present invention contains an ester wax and a hydrocarbon wax, but the mass ratio of the ester wax to the hydrocarbon wax (ester wax/hydrocarbon wax) can be 1/1 or higher and 3/1 or lower. In the case where the ratio is 1/1 or higher and 3/1 or lower, the crystallization speed when the volatilized wax component is solidified becomes slow and the particle diameter of a solidified substance becomes large, which is preferable.

It is important that an ester wax used for the toner according to the present invention is a bifunctional ester wax represented by the following formula (1) or (2).

$$R_1—CO—O—(CH_2)_x—O—OC—R_2 \quad \text{Formula (1):}$$

$$R_3—O—OC—(CH_2)_x—CO—O—R_4 \quad \text{Formula (2):}$$

($R_1$ to $R_4$ are an alkyl group; and x is an integer of 8 to 10.)

If the ester wax is an ester wax having the above structure, the effect described hitherto can sufficiently be attained and no density thinness at both ends of images occurs. The reason therefor is unclear, but the inventors presume that since the ester wax has a higher molecular weight than a monoester wax, and the molecule has an elongated slender molecule shape and has a large excluded volume, the crystallization speed becomes slow.

By contrast, a monoester is not preferable because the crystal of a solidified substance is small for the above reason. A tri-functional or higher ester wax (for example, a wax obtained by adding a straight chain fatty acid to glycerol) has a nearly spherical shape of its molecule. Hence, the ester wax, since having a small excluded volume, exhibits a higher crystallization speed than an ester wax of Formula (1) or (2), and the particle diameter of a solidified substance resultantly becomes small, which is not preferable.

An ester wax usable for the toner according to the present invention is a bifunctional ester wax represented by Formula (1) or (2), and x is an integer of 8 to 10.

As described hitherto, it is very important in the present invention that the wax is volatilized; the melting point lowering of the wax is caused; and further the crystallization speed in the solidification process is controlled. As a result of exhaustive studies from this viewpoint by the inventors, it is important that x is an integer of 8 to 10. If x is 8 to 10, the melting point lowering is caused and the crystallization speed in solidification is suppressed, so the condition of x is essential.

By contrast, in the case where x is an integer of 7 or less, the melting point lowering comes to be hardly caused and additionally, the particle diameter of a solidified substance comes to be small. This is because an ester wax having a shorter carbon chain length of its central skeleton is more easily crystallized, and is easily codissolved with a hydrocarbon wax. Also in the case where x is an integer of 11 or more, no melting point lowering is caused. This is because since the carbon chain length of the central skeleton is long, the affinity for a hydrocarbon wax worsens. Similarly, an ester wax having an aromatic compound such as terephthalic acid in its molecule layer-separates from a hydrocarbon wax, which is not preferable.

Dicarboxylic acids specifically include decanoic diacid and dodecanoic diacid; and diols specifically include 1,8-octanediol, 1,9-nonanediol and 1,10-decanediol. Here, straight chain fatty acids and straight chain alcohols have been shown as examples, but dicarboxylic acids and diols may have a branch structure.

In a bifunctional ester wax represented by Formula (1) or (2), $R_1$ to $R_4$ can be an alkyl group having 13 to 26 carbon atoms.

If the number of carbon atoms of $R_1$ to $R_4$ is 13 or more and 26 or less, the melting point lowering is easily caused in a combination with a hydrocarbon wax, and further since the melting point of the wax is relatively rather high, the ester wax hardly has an influence on the preservability and the like, which is preferable. Fatty acids specifically include myristic acid, palmitic acid, margaric acid, stearic acid, tuberculostearic acid, arachidic acid, behenic acid, lignoceric acid and cerotic acid. Aliphatic alcohols include tetradecanol, pentadecanol, hexadecanol, heptadecanol, octadecanol, nonadecanol, eicosanol, docosanol, tricosanol, tetracosanol, pentacosanol and hexacosanol.

The toner according to the present invention has, in order to faithfully develop finer latent image dots to attain the image quality enhancement, a weight-average particle diameter (D4) of the toner of preferably 3 μm or larger and 12 μm or smaller, and more preferably 4 μm or larger and 9 μm or smaller. If the weight-average particle diameter (D4) is in the above range, the fluidity and the stirring property as a powder are proper, and uniform charging of individual toner particles becomes easy. Further, good dot reproducibility becomes to be easily attained.

The toner according to the present invention can have an average degree of circularity of 0.950 or higher. A toner having an average degree of circularity of 0.950 or higher has a spherical shape or a shape near thereto, and is excellent in fluidity and easily provides the uniform frictional charging property, which is preferable.

The toner according to the present invention, in a molecular weight distribution of a tetrahydrofuran-soluble matter of the toner by gel permeation chromatography (GPC), can exhibit a peak top of a main peak in the molecular weight range of 8,000 to 30,000. If the peak top is lower than 8,000, a problem with the preservation stability of the toner may be caused, and the toner may be remarkably deteriorated in long-term use. By contrast, in the case where the peak top exceeds 30,000, the low-temperature fixing property worsens.

The toner according to the present invention has a tetrahydrofuran (THF)-insoluble matter in its resin component, and the tetrahydrofuran-insoluble matter can be 5.0% by mass or more and 65.0% by mass or less with respect to the resin component. The presence of the tetrahydrofuran-insoluble matter in the toner can increase the strength of the toner, make the toner deterioration to be hardly caused even in long-term use, and provide highly vivid images even in long-term use.

The toner melts by heat received from a fixing assembly in the fixing time, but the presence of 5.0% by mass or more and 65.0% by mass or less of a tetrahydrofuran-insoluble matter enables giving a suitable viscoelasticity also in the melting time. Hence, the adhesion of the toner on a fixing member (for example, a film) is hardly caused also in the fixing time, which is preferable.

The THF-insoluble matter in the resin component of the toner can optionally be changed depending on the combination of kinds, amounts and the like of an initiator and a crosslinking agent to be used, and can be adjusted also by use of a chain transfer agent and the like.

The toner according to the present invention can have a glass transition temperature (Tg) of 40° C. or higher and 70° C. or lower. If the glass transition temperature is lower than 40° C., the preservation stability decreases and the toner deterioration is liable to be caused in long-term use; and if higher than 70° C., the fixing property worsens. Therefore, in consideration of the balance among the fixing property, the preservation stability and the developing property, the glass transition temperature of the toner can be 40° C. or higher and 70° C. or lower.

Binder resins usable for the toner according to the present invention are homopolymers of styrene and substitution products thereof such as polystyrene and polyvinyl toluene; styrene-based copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; and polymethyl methacrylate, polybutyl methacrylate, polyvinyl acetate, polyethylene, polypropylene, polyvinyl butyral, silicone resins, polyester resins, polyamide resins, epoxy resins, and polyacrylic acid resins. These can be used singly or in a combination of a plurality of kinds thereof. Among these, styrene-based copolymers and polyester resins are especially preferable from the point of the development property, the fixing property and the like.

In the toner according to the present invention, in order to improve the charging property, as required, a charge-controlling agent may be blended. A well-known charge-controlling agent can be used, but a charge-controlling agent exhibiting a high charging speed, and being capable of stably maintaining a constant charge amount is especially preferable. Further, in the case where the toner is produced by using a polymerization method as described later, a charge-controlling agent being low in the polymerization inhibition and having substantially no soluble matter to an aqueous disperse medium is especially preferable. Among charge-controlling agents, compounds as negative charge-controlling agents specifically include metal compounds of aromatic carboxylic acids such as salicylic acid, alkyl salicylates, dialkyl salicylates, naphthoic acid and dicarboxylic acids; metal salts or metal comolexes of azo dyes or azo pigments; polymeric compounds having a sulfonic acid or carboxylic acid group on their side chains; boron compounds; urea compounds; silicon compounds; and calixarenes. Positive charge-controlling agents include quaternary ammonium salts, polymeric compounds having the quaternary ammonium salts on their side chains, guanidine compounds, nigrosine-based compounds and imidazole compounds.

Methods for incorporating a charge-controlling agent in the toner are usually a method of adding the charge-controlling agent internally in toner particles, and in the case where the production of the toner is carried out by suspension polymerization, a method of adding the charge-controlling agent in a polymerizable monomer composition before granulation. Also, a method can be used in which oil droplets are formed in water, and during polymerization or after the polymerization, a polymerizable monomer having a charge-controlling agent dissolved or dispersed therein is added to carry out seed polymerization to thereby uniformly cover the toner surface. In the case of using an organometal compound as a charge-controlling agent, also a method can be used in which the compound is added in toner particles, and is imparted with shearing to be mixed and stirred to thereby incorporate the charge-controlling agent.

The amount of a charge-controlling agent used can be determined depending on the kind of a binder resin, the presence/absence of other additives, and a toner production method including a dispersion method, and is not unambiguously limited. However, in the case where a charge-controlling agent is added internally in toner particles, the charge-controlling agent is used, with respect to 100 parts by mass of a binder resin, preferably in the range of 0.1 parts by mass or larger and 10 parts by mass or smaller, and more preferably 0.1 parts by mass or larger and 5 parts by mass or smaller. In the case where a charge-controlling agent is added externally in toner particles, the charge-controlling agent is used, with respect to 100 parts by mass of the toner, preferably in the range of 0.005 parts by mass or larger and 1.0 part by mass or smaller, and more preferably 0.01 parts by mass or larger and 0.3 parts by mass or smaller.

The toner according to the present invention contains a colorant to a target color tone. Colorants usable for the toner according to the present invention are any of well-known organic pigments or dyes, carbon black, magnetic powders and the like.

Specifically, cyan colorants which can be used are copper phthalocyanine compounds and derivatives thereof, anthraquinone compounds, basic dye lake compounds and the like. The cyan colorants specifically include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

Magenta colorants to be used are condensed azo compounds, diketopyrrolopyrrole compounds, anthraquinone, quinacridone compounds, basic dye lake compounds, naphthol compounds, benzimidazolone compounds, thioindigo compound and perylene compounds. The magenta colorants specifically include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, and C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Yellow colorants to be used are compounds represented by condensed azo compounds, isoindolinone compounds, anthraquinone compounds, azo metal complexes, methine compounds and allylamide compounds. The yellow colorants specifically include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

These colorants can be used singly or as a mixture of two or more, or further also in a solid solution state. The colorant used for the toner according to the present invention is suitably selected from points of the hue angle, the chroma, the luminosity, the light resistance, the OHP transparency, and the dispersibility to the toner. The amount of a colorant added can be 1 part by mass or larger and 20 parts by mass or smaller with respect to 100 parts by mass of a binder resin.

Black colorants to be utilized are carbon black, magnetic powder, and substances color-toned to black using the above yellow, magenta and cyan colorants. In the case of using carbon black as the black colorant, the amount added thereof can be 1 part by mass or larger and 20 parts by mass or smaller with respect to 100 parts by mass of a binder resin.

In the case of using the toner according to the present invention as a magnetic toner, a magnetic powder may be used as a colorant. In the case of using a magnetic powder as a black colorant, the magnetic powder can be used in 20 parts by mass or larger and 150 parts by mass or smaller with respect to 100 parts by mass of a binder resin. If the amount of a magnetic powder added is smaller than 20 parts by mass, although the fixing property becomes good, the coloring power of the toner is poor and the suppression of fogging is difficult. By contrast, if exceeding 150 parts by mass, the fixing property worsens and the holding force due to a magnetic force of a toner carrier is strengthened to thereby reduce the developing property in some cases, which is not preferable.

The measurement of the content of a magnetic powder in a toner can be carried out using a thermoanalyzer, manufactured by PerkinElmer Inc., TGA7. The measurement method is as follows. The toner is heated under a nitrogen atmosphere at a temperature-rise rate of 25° C./min from normal temperature to 900° C. A loss mass percent from 100° C. to 750° C. is taken as a binder resin amount, and the remaining mass is taken approximately as a magnetic powder amount.

In the case of producing a toner by using a polymerization method in the present invention, attention to the polymerization inhibition and the water-phase migration which a colorant has needs to be paid. Then, subjecting the colorant to surface modification, for example, a hydrophobization treatment to the colorant using a substance having no polymerization inhibition is better. Particularly, since many of dyes and carbon black have the polymerization inhibition, attention needs to be paid in use. Carbon black may be treated with a substance reacting with surface functional groups of the carbon black, for example, with a polyorganosiloxane.

In the case of using a magnetic powder for the toner according to the present invention, the magnetic powder contains a magnetic iron oxide such as triiron tetraoxide or γ-iron oxide as a main component, and may contain elements such as phosphorus, cobalt, nickel, copper, magnesium, manganese, aluminum and silicon. The magnetic powder has a BET specific surface area by the nitrogen adsorption method of preferably 2 $m^2/g$ or larger and 30 $m^2/g$ or smaller, and more preferably 3 $m^2/g$ or larger and 28 $m^2/g$ or smaller. The magnetic powder can have a Mohs hardness of 5 to 7. The shape of the magnetic powder is a polyhedron, an octahedron, a hexahedron, a spherical shape, an acicular shape, a scaly shape or the like, but shapes having little anisotropy, such as a polyhedron, an octahedron, a hexahedron or a spherical shape, are preferable in order to enhance the image density.

The magnetic powder can have a volume-average particle diameter of 0.10 μm or larger and 0.40 μm or smaller. A magnetic powder having a smaller particle diameter, though generally giving a higher coloring power, more easily aggregates to give an inferior homogeneous dispersibility of the magnetic powder in a toner, which is not preferable. With the volume-average particle diameter of smaller than 0.10 μm, the magnetic powder itself assumes reddish black, and makes images outstanding in reddishness particularly in halftone images to thereby make images which cannot be said to be of a high quality, which is not preferable. By contrast, if the volume-average particle diameter exceeds 0.40 μm, the coloring power of the toner becomes insufficient, and in a suspension polymerization method (described later) as a suitable production method of the toner according to the present invention, homogeneous dispersion becomes difficult, which is not preferable.

The volume-average particle diameter of a magnetic powder can be measured using a transmission electron microscope. Specifically, toner particles to be observed are sufficiently dispersed in an epoxy resin, which is then cured at a temperature atmosphere of 40° C. for 2 days to thereby obtain a cured material. The obtained cured material is made into a flake sample by a microtome, and the particle diameters of 100 magnetic powder particles are measured in the visual field of a photograph with a magnification of 10,000 to 40,000 times in a transmission electron microscope (TEM). Then, based on equivalent diameters of circles equal to projection areas of the magnetic powder, the volume-average particle diameter is calculated. The particle diameter can also be measured by an image analyzer.

A magnetic powder used for the toner according to the present invention can be produced, for example, by the following method. An alkali such as sodium hydroxide of an equivalent weight or more to an iron component is added to a ferrous salt aqueous solution to thereby prepare an aqueous solution containing ferrous hydroxide. The oxidation reaction of ferrous hydroxide is carried out while air is blown in under maintenance of the pH of the prepared aqueous solution at 7 or higher, and the aqueous solution is heated at 70° C. or higher, to thereby first produce a seed crystal to become a core of a magnetic iron oxide powder.

An aqueous solution containing ferrous sulfate of about one equivalent weight based on the amount of the alkali added which is previously added in the above is added to the slurry liquid containing the seed crystal. The reaction of ferrous hydroxide is progressed while air is blown in under maintenance of the pH of the liquid at 5 to 10, to thereby grow the magnetic iron oxide powder with the seed crystal as the core. At this time, the shape and the magnetic property of the magnetic powder can be controlled by optionally selecting the pH, the reaction temperature and the stirring condition. Although the pH of the liquid moves to an acidic side as the oxidation reaction progresses, it is preferable that the pH of the liquid be not made to be lower than 5. A magnetic material thus obtained is filtered, cleaned and dried by usual methods to thereby obtain the magnetic powder.

In the case of producing a toner by a polymerization method in the present invention, the magnetic powder surface is much preferably subjected to a hydrophobization treatment. In the case of carrying out the surface treatment by a dry system, a magnetic powder cleaned, filtered and dried is subjected to a coupling agent treatment. In the case of carrying out the surface treatment by a wet system, a magnetic powder dried is redispersed after the termination of the oxidation reaction, or an iron oxide material obtained by cleaning and filtration is redispersed in another aqueous medium without being dried after the termination of the oxidation reaction, and the coupling treatment is then carried out. Specifically, a silane coupling agent is added while the redispersed liquid is sufficiently stirred, and the coupling treatment is carried out by raising the temperature after hydrolysis, or by regulating the pH of the dispersed liquid to an alkali range after hydrolysis. Among these, from the viewpoint of carrying out a uniform surface treatment, it is preferable that a magnetic powder as it is after the termination of the oxidation reaction and without being dried after filtration and cleaning be made into a slurry and be subjected to the surface treatment.

In order to carry out a surface treatment in a wet system for the magnetic powder, that is, to treat a magnetic powder with a coupling agent in an aqueous medium, first, the magnetic powder is sufficiently dispersed in the aqueous medium so as to have a primary particle diameter, and stirred by a stirring blade or the like so as not to be settled and aggregated. Then, any amount of a coupling agent is charged in the above dispersed liquid, and the surface treatment is carried out while the coupling agent is being hydrolyzed; also at this time, it is more preferable that the surface treatment be carried out while the magnetic powder is sufficiently dispersed under stirring so as not to be aggregated by using an apparatus such as a pin mill or a line mill.

The aqueous medium used here is a medium containing water as a major component. The aqueous medium specifically includes water itself, water containing a small amount of a surfactant added thereto, water containing a pH regulator added thereto, and water containing an organic solvent added thereto. The surfactant can be a nonionic surfactant such as a polyvinyl alcohol. The surfactant can be added in 0.1% by mass or more and 5.0% by mass or less with respect to water. The pH regulator includes inorganic acids such as hydrochloric acid. The organic solvent includes alcohols.

Examples of the coupling agent usable in the surface treatment of the magnetic powder in the present invention include silane coupling agents and titanium coupling agents. A coupling agent to be used more preferably is a silane coupling agent, which is represented by the general formula (I).

$$R_mSiY_n \quad (I)$$

In the formula, R represents an alkoxy group; m represents an integer of 1 to 3; Y represents a functional group such as an alkyl group, a vinyl group, an epoxy group and a (meth)acryl group; and n represents an integer of 1 to 3; provided m+n=4.

Examples of the silane coupling agent represented by the general formula (I) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Among these, from the viewpoint of imparting a high hydrophobicity to the magnetic powder, alkyltrialkoxysilane coupling agents represented by the following general formula (II) can be used.

$$C_pH_{2p+1}—Si—(OC_qH_{2q+1})_3 \quad (II)$$

In the formula, p represents an integer of 2 to 20; and q represents an integer of 1 to 3.

If p in the above formula is less than 2, it is difficult to sufficiently impart the hydrophobicity to the magnetic powder, and by contrast, if p is more than 20, although the hydrophobicity becomes sufficient, the unification of magnetic powders occurs much, which is not preferable. Further, if q is more than 3, since the reactivity of a silane coupling agent decreases and the hydrophobization is hardly sufficiently carried out, an alkyltrialkoxysilane coupling agent is preferably used in which p in the formula represents an integer of 2 to 20 (more preferably an integer of 3 to 15) and q represents an integer of 1 to 3 (more preferably an integer of 1 or 2).

In the case of using the above silane coupling agent, the treatment can be carried out with a silane coupling agent singly, or with combined use of a plurality of kinds thereof. In the case of the combined use of a plurality of kinds thereof, the treatment may be carried out with each coupling agent, or simultaneously with the coupling agents.

The total amount for the treatment of the coupling agents to be used can be 0.9 parts by mass or larger and 3.0 parts by mass or smaller with respect to 100 parts by mass of a magnetic powder, and it is important that the amount of the treating agent is adjusted depending on the surface area of the magnetic powder, the reactivity of the coupling agent, and the like.

In the present invention, another colorant other than the magnetic powder may be used in a combination. The colorant usable in a combination includes, in addition to the above well-known dyes and pigments, magnetic or nonmagnetic inorganic compounds. The colorant specifically includes particles of ferromagnetic metals such as cobalt and nickel, or alloys obtained by adding chromium, manganese, copper, zinc, aluminum, a rare earth element, or the like to the ferromagnetic metal, particles of hematite or the like, titanium black, nigrosine dye or pigment, carbon black and phthalocyanine. These also can be used by treating their surface.

The toner according to the present invention has a core-shell structure; and the core layer can be made by containing a styrene-acrylic resin, and the shell layer can be made by containing an amorphous polyester resin. In the present invention, "having a core-shell structure" refers to a structure in which a shell layer covers the surface of a core layer. Here, "cover" means that the surface of the core layer is covered and enveloped with the shell layer.

Making the toner have a core-shell structure, making the core layer contain a styrene-acrylic resin and using an amorphous polyester resin for the shell layer make the rising of charging of the toner good and improve the durability, which are preferable.

A colorant and a release agent contained in a toner are generally likely to inhibit the chargeability of the toner. Hence, providing the shell layer prevents exposure of the colorant and the release agent and makes the rising of charging good. Further, the use of a styrene-acrylic resin for the core layer and an amorphous polyester resin for the shell layer makes the styrene-acrylic resin and the polyester resin to be easily phase-separated and makes the shell layer to easily uniformly cover the core layer. Hence, the above effect becomes remarkable, which is preferable.

The incorporation of the core-shell structure further makes the wax present in the core portion, and even in the incorporation of the wax in a large amount, the wax enables plasticizing the styrene-acrylic resin before the wax oozes out in the fixing time. As a result, the amount infiltrated (amount codissolved) of the wax into the resin increases, and the amount of the wax component volatilized decreases, which is much preferable.

In the present invention, the above amorphous polyester resin is not especially limited as long as being an amorphous polyester resin obtained by polycondensing a polyhydric alcohol and a polyvalent carboxylic acid. For the reason described later, however, the above amorphous polyester resin is more preferably an amorphous polyester resin being obtained by polycondensing an alcohol component containing 80% by mol or more of a bisphenol A propylene oxide adduct with a carboxylic acid component, and having an average addition molar number of the propylene oxide adduct of 1.8 or more and 2.3 or less.

As described above, by uniformly covering the core with the shell layer, the amount of the wax component volatilized can be reduced; hence, the core can be covered uniformly with the shell layer.

Then, as a result of exhaustive studies by the inventors, the core layer is enabled to be more uniformly covered by making the alcohol component of the amorphous polyester resin as described above even if the amorphous polyester resin being the shell layer is in a small amount.

The inventors consider the reason therefor such that the above amorphous polyester resin can be said to have a relatively simple structure as a structure of polyesters; hence, the above amorphous polyester resin more easily makes a homogeneous composition than other polyesters having a complex structure, and a small amount of the amorphous polyester resin enables uniformly covering the core layer.

Further, since such an amorphous polyester resin has a high glass transition temperature (Tg), the durability deterioration of the toner is easily suppressed, which is preferable. Further, since the glass transition temperature of the shell layer becomes high, the melt viscosity of the surface-layer resin in the fixing time becomes relatively high, and the amount of the wax component volatilized can be suppressed, which is much preferable.

In the present invention, the glass transition temperature (Tg) of the above amorphous polyester resin can be 75° C. or higher and 90° C. or lower. If the glass transition temperature (Tg) of the amorphous polyester resin is 75° C. or higher, since the toner deterioration can be suppressed, the durability is improved. Thereby, a high development efficiency can be maintained and a sufficient image density can be provided even after the endurance.

An amorphous polyester resin used for the toner according to the present invention can be selected suitably from a saturated polyester resin, an unsaturated polyester resin and the both, and used.

An amorphous polyester resin usable in the present invention is a usual amorphous polyester resin constituted of an alcohol component and an acid component, and examples of both the components are shown below.

The alcohol component includes ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, bisphenol derivatives represented by the following formula (1-1), hydrogenated substances of the following formula (1-1) and diols represented by the following formula (1-2).

(1-1)

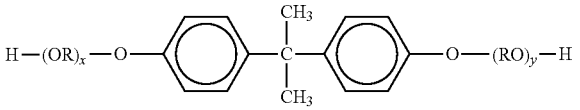

In the formula, R is an ethylene group or a propylene group; and x and y are each an integer of 1 or more, and an average value of x+y is 2 to 10.

(1-2)

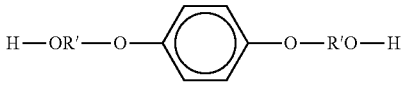

[In the formula, R' is

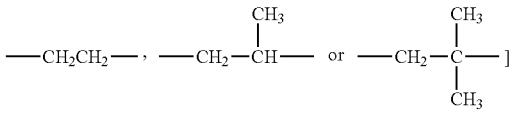

As described above, the amorphous polyester resin in the present invention is preferably an amorphous polyester resin obtained by polycondensing an alcohol component containing 80% by mol or more (more preferably 90% by mol or more) of a bisphenol A propylene oxide adduct with a carboxylic acid component, and having an average addition molar number of the propylene oxide adduct of 1.8 or more and 2.3 or less.

On the other hand, the divalent carboxylic acid constituting the amorphous polyester resin includes benzenedicarboxylic acids or anhydrides thereof such as phthalic acid, terephthalic acid, isophthalic acid and phthalic anhydride; and alkyldicarboxylic acids and anhydrides thereof such as succinic acid, adipic acid, sebacic acid and azelaic acid. The divalent carboxylic acid further includes succinic acid substituted with an alkyl group or alkenyl group having 6 to 18 carbon atoms, or anhydrides thereof; and unsaturated dicarboxylic acids or anhydrides thereof such as fumaric acid, maleic acid, citraconic acid and itaconic acid.

Further, the alcohol component includes polyhydric alcohols such as glycerol, pentaerythritol, sorbit, sorbitan and oxyalkylene ethers of novolac phenol resins; and the acid component includes polyvalent carboxylic acids such as trimellitic acid, pyromellitic acid, 1,2,3,4-butanetetracarboxylic acid, benzophenonetetracarboxylic acid and anhydrides thereof.

In the amorphous polyester resin used in the present invention, the alcohol component can account for 45% by mol to 55% by mol in all the components; and the acid component can account for 55% by mol to 45% by mol therein.

The amorphous polyester resin can be produced by using any catalyst to be usually used, for example, a metal such as tin, titanium, antimony, manganese, nickel, zinc, lead, iron, magnesium, calcium or germanium; and a compound containing these metals. Particularly an amorphous polyester resin obtained by polycondensation using a titanium-based catalyst among these catalysts is preferable.

Since an amorphous polyester resin obtained by polycondensation using a titanium-based catalyst easily makes a homogeneous polyester resin, the variation among toner particles becomes small. Hence, particularly in a suspension polymerization method being a preferable production method of the toner according to the present invention, the shell layer of the toner particles is enabled to be uniformly constituted, which is much preferable.

In the present invention, the content of the amorphous polyester resin is, with respect to 100 parts by mass of a binder resin, preferably 1 part by mass or higher and 10 parts by mass or lower, and more preferably 2 parts by mass or higher and 8 parts by mass or lower.

As a specific method of forming a shell layer using the amorphous polyester resin, the shell layer may be formed by embedding fine particles for shell in a core particle.

In the case of producing a toner in an aqueous medium, which is a production method suitable for the present invention, a shell layer can be formed by adhering ultrafine particles for shell on a core particle, and drying. Further, in a dissolution suspension method and a suspension polymerization method, a shell layer can be formed by utilizing the acid value and the hydrophilicity of an amorphous polyester resin for shell, and making the amorphous polyester resin to be locally present at the interface with water, that is, in the vicinity of the toner surface.

In the toner according to the present invention, the styrene-acrylic resin constituting the core layer is a resin obtained by copolymerizing styrene with (meth)acrylic acid or a derivative thereof, and means a well-known resin called a styrene-acrylic resin.

Examples of polymerizable monomers to form the above styrene-acrylic resin include the following.

Styrene-based polymerizable monomers include styrene; α-methylstyrene, o-methylstyrene, m-methylstyrene, p-methylstyrene and p-methoxystyrene.

Acryl-based polymerizable monomers include methyl acrylate, ethyl acrylate, n-propyl acrylate, iso-propyl acrylate, n-butyl acrylate, iso-butyl acrylate, tert-butyl acrylate, n-hexyl acrylate, 2-ethylhexyl acrylate, n-octyl acrylate and cyclohexyl acrylate.

Methacryl-based polymerizable monomers include methyl methacrylate, ethyl methacrylate, n-propyl methacrylate, iso-propyl methacrylate, n-butyl methacrylate, iso-butyl methacrylate, tert-butyl methacrylate, n-hexyl methacrylate, 2-ethylhexyl methacrylate and n-octyl methacrylate.

A method for producing the styrene-acrylic resin is not especially limited, and a well-known method can be used. The content of the styrene-acrylic resin with respect to the total amount of a binder resin is preferably 70% by mass or higher, and more preferably 80% by mass or higher.

The binder resin can further contain, in addition to the above amorphous polyester resin and the above styrene-acrylic resin, well-known resins used for binder resins of toners in the extent of not imparting an influence on the effect of the present invention.

The toner according to the present invention can be produced by any well-known method, but the toner is produced preferably in an aqueous medium by a dispersion polymerization method, an association aggregation method, a dissolution suspension method, a suspension polymerization method or the like, and particularly the suspension polymerization method easily satisfies suitable physical properties of the present invention, which is much preferable.

The suspension polymerization method involves homogeneously dissolving or dispersing a polymerizable monomer and a colorant (as required further a polymerization initiator, a crosslinking agent, a charge-controlling agent, and other additives) to thereby obtain a polymerizable monomer composition; thereafter, the polymerizable monomer composition is dispersed in a continuous layer (for example, water phase) containing a dispersant by using a proper stirrer to simultaneously carry out the polymerization reaction to thereby obtain a toner having a desired particle diameter. Since the toner obtained by the suspension polymerization method (hereinafter, also referred to as "polymerization toner") has shapes of individual toner particles being uniformly nearly spherical, a toner can easily be obtained which satisfies such a physical property requirement suitable for the present invention that the average degree of circularity is 0.950 or higher. Further, since the distribution of the charging amount of such a toner becomes relatively uniform, the improvement in the image quality can be anticipated.

In the production of the polymerization toner relevant to the present invention, the polymerizable monomer constituting the polymerizable monomer composition includes the following.

The polymerizable monomer includes styrene-based monomers such as styrene, o-methylstyrene, m-methylstyrene, p-methylstyrene, p-methoxystyrene and p-ethylstyrene; acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and additionally monomers such as acrylonitrile, methacrylonitrile and acrylamide. These monomers can be used singly or as a mixture thereof. Among the above monomers, styrene or a styrene derivative is preferably used singly or as a mixture with another monomer from the point of the development property and the durability of the toner.

A polymerization initiator used in the production by a polymerization method of the toner according to the present invention can have a half-life period of 0.5 to 30 hours in the polymerization reaction time. If the polymerization reaction is carried out in an amount of the polymerization initiator added of 0.5 parts by mass or larger and 20 parts by mass or smaller with respect to a polymerizable monomer, a polymer having a maximum molecular weight between 5,000 to 50,000 is obtained, and a desired strength and a proper melt property can be imparted to the toner.

Specific examples of the polymerization initiator include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile, and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate and t-butyl peroxypivalate.

In the case of producing the toner according to the present invention by a polymerization method, a crosslinking agent may be added, and a preferable amount added is 0.001% by mass or larger and 15% by mass or smaller with respect to 100 parts by mass of a polymerizable monomer.

Here, as the crosslinking agent, a compound having two or more polymerizable double bonds is used, and examples thereof include aromatic divinyl compounds such as divinylbenzene and divinylnaphthalene; carboxylate esters having two double bonds such as ethylene glycol diacrylate, ethylene glycol dimethacrylate and 1,3-butanediol dimethacrylate; divinyl compounds such as divinylaniline, divinyl ether, divinyl sulfide and divinyl sulfone; and compounds having three or more vinyl groups. These are used singly or as a mixture of two or more.

A method for producing the toner according to the present invention by a polymerization method usually involves suspending in an aqueous medium containing a dispersant a polymerizable monomer composition in which the above toner composition and the like are suitably added and homogeneously dissolved or dispersed by a dispersing machine such as a homogenizer, a ball mill or an ultrasonic dispersing machine. At this time, making a desired size of toner particles at a stretch by using a high-speed dispersing machine such as a high-speed stirrer or an ultrasonic dispersing machine makes the particle diameters of the obtained toner particles to be sharper. The timing of adding a polymerization initiator may be such that the polymerization initiator is added simultaneously when other additives are added in the polymerizable monomer, or the polymerization initiator is mixed right before being suspended in the aqueous medium. Alternatively, the polymerization initiator dissolved in the polymerizable monomer or a solvent may be added right after the granulation and before the initiation of the polymerization reaction.

After the granulation, the stirring may be carried out in such a degree that the particle state is maintained and floatation and settlement of particles are prevented by using a usual stirrer.

In the case of producing the toner according to the present invention, as a dispersant, a well-known surfactant, organic dispersant or inorganic dispersant can be used. Among these, an inorganic dispersant can be used preferably because the inorganic dispersant hardly produces hazardous ultrafine powder, has the dispersion stability due to its steric hindrance and therefore hardly destroys the stability even if the reaction temperature is varied, and is easily cleaned and therefore hardly adversely affects the toner. Examples of such an inorganic dispersant include phosphoric acid polyvalent metal salts such as tricalcium phosphate, magnesium phosphate, aluminum phosphate, zinc phosphate and hydroxyapatite, carbonate salts such as calcium carbonate and magnesium carbonate, inorganic salts such as calcium metasilicate, calcium sulfate and barium sulfate, and inorganic compounds such as calcium hydroxide, magnesium hydroxide and aluminum hydroxide.

The inorganic dispersant is desirably used in 0.2 parts by mass or more and 20 parts by mass or less with respect to 100 parts by mass of a polymerizable monomer. The dispersant may be used singly or in a combination of a plurality of kinds thereof. Further, 0.001 parts by mass or more and 0.1 parts by mass or less of a surfactant may be used in a combination.

In the case of using these inorganic dispersants, the inorganic dispersants may be used as they are, but can be used by producing particles of the inorganic dispersants in an aqueous medium in order to obtain finer particles. For example, in the case of tricalcium phosphate, a sodium phosphate aqueous solution and a calcium chloride aqueous solution are mixed under high-speed stirring to thereby enable producing water-insoluble calcium phosphate, enabling more uniform and finer dispersion. At this time, water-soluble sodium chloride salts are simultaneously by-produced, but if water-soluble salts are present in the aqueous medium, the dissolution of the polymerizable monomer in water is suppressed to thereby make ultrafine particle toner to be hardly generated by emulsion polymerization, which is more advantageous.

Examples of the surfactant include sodium dodecylbenzenesulfate, sodium tetradecylsulfate, sodium pentadecylsulfate, sodium octylsulfate, sodium oleate, sodium laurate, sodium stearate and potassium stearate.

In a step of polymerizing the above polymerizable monomer, the polymerization temperature is set at 50° C. or higher and 90° C. or lower. If the polymerization is carried out in this temperature range, low-melting point substances to be enclosed in the inside are deposited by phase-separation to thereby make the inclusion more complete. After the termination of the polymerization reaction, in order to control the codissolved state of the wax, the polymerization system is heated to a temperature equal to or higher than the melting point of the wax, and in the cooling process thereafter, the cooling rate can be made to be, for example, 0.3° C./min or higher and 3° C./min or lower.

Thereafter, the obtained polymer particles are filtered, cleaned and dried by well-known methods to thereby obtain toner particles. An inorganic fine powder as described later is, as required, mixed in the toner particles and made to adhere on the surface of the toner particles to thereby obtain the toner according to the present invention. By incorporating a classification step in the production step (before the mixing of the inorganic fine powder), coarse powder and fine powder contained in the toner particles may be removed.

Addition of an inorganic fine powder as a fluidizing agent in which the number-average particle diameter of primary particles is 4 to 80 nm, more preferably 6 to 40 nm to the toner particles is a preferred embodiment of the toner in the present invention. Although the inorganic fine powder is added in order to improve the fluidity of the toner and uniformize the charging of the toner particles, impartation of functions including regulation of the charging amount and improvement in the environmental stability of the toner by subjecting the inorganic fine powder to a hydrophobization treatment and the like is also a preferred embodiment.

In the case where the number-average particle diameter of primary particles of the inorganic fine powder is larger than 80 nm, or in the case where no inorganic fine powder of 80 nm or smaller is added, the good fluidity of the toner cannot be provided, and the charge impartation to the toner particles is liable to become ununiform, which is not preferable. By contrast, in the case where the number-average particle diameter of primary particles of the inorganic fine powder is smaller than 4 nm, the aggregating property of the inorganic fine powder is enhanced, and the inorganic fine powder is liable to behave as an aggregated material which is not primary particles, has a firm aggregating property of being hardly disintegrated even by a disintegration treatment, and has a broad particle size distribution. Hence, the aggregated material comes to be developed and the aggregated material mars an image carrier, a toner carrier or the like to be liable to thereby cause image defects, which is not preferable.

In the present invention, a measurement method of the number-average particle diameter of primary particles of an inorganic fine powder involves using an enlarged photograph of a toner taken by a scanning electron microscope.

Inorganic fine powders usable in the present invention are silica, titanium oxide, alumina and the like. Silica fine powders usable are, for example, both of a dry silica obtained by a so-called dry method of production using the vapor phase oxidation of a silicon halide, or called fumed silica, and a so-called wet silica produced from water glass or the like. However, the dry silica is preferable, in which silanol groups are few on the surface and the inside of the silica fine powder and production residues such as $Na_2O$ and $SO_3^{2-}$ are little. In a production step of a dry silica, for example, a composite fine powder of silica and another metal oxide can be obtained by using another metal halide such as aluminum chloride or titanium chloride together with the silicon halide, and the dry silica includes such fine powder.

The amount of an inorganic fine powder added having a number-average particle diameter of primary particles of 4 to 80 nm can be 0.1 to 3.0% by mass with respect to the toner particles; if the amount added is smaller than 0.1% by mass, the effect is insufficient; and if exceeding 3.0% by mass, the fixing property worsens. The content of an inorganic fine powder can be quantitatively determined using an X-ray fluorescence analysis and using a calibration curve fabricated using a standard sample.

In the present invention, the inorganic fine powder can be an inorganic fine powder having been subjected to a hydrophobization treatment because the environmental stability of the toner can be improved. If the inorganic fine powder added to the toner absorbs moisture, the charging amount of the toner particles remarkably decreases; the charging amount is liable to become ununiform; and the toner scattering is liable to be caused. A treating agent used for the hydrophobization treatment of the inorganic fine powder, such as silicone varnishes, various types of modified silicone varnishes, silicone oils, various types of modified silicone oils, silane compounds, silane coupling agents, other organosilicon compounds and organotitanium compounds, may be used singly or in a combination of two or more.

An inorganic fine powder treated with a silicone oil among the above treating agents is preferable; and an inorganic fine powder treated with a silicone oil simultaneously when or after the inorganic fine powder is subjected to a hydrophobization treatment with a silane compound is more preferable. Such a treatment method of an inorganic fine powder can involve, for example, as a first-stage reaction, carrying out a silylation reaction with a silane compound to thereby eliminate silanol groups by chemical bonds, and thereafter, as a second-stage reaction, forming a hydrophobic thin film with a silicone oil on the surface.

A method of treating an inorganic fine powder with a silicone oil includes, for example, a method in which an inorganic fine powder treated with a silane compound and a silicone oil are directly mixed using a mixer such as a Henschel mixer, and a method in which a silicone oil is sprayed on an inorganic fine powder. Alternatively, the method may be a method in which after a silicone oil is dissolved or dispersed in a suitable solvent, an inorganic fine powder is added and mixed, and the solvent is removed. The spraying method is more preferable in that the production of aggregated materials of the inorganic fine powder is relatively little.

The amount of a silicone oil treated is, with respect to 100 parts by mass of an inorganic fine powder, 1 part by mass or larger and 40 parts by mass or lower, and preferably 3 parts by mass or larger and 35 parts by mass or lower. If the amount of a silicone oil is too small, the good hydrophobicity cannot be provided; and if too large, malfunctions such as occurrence of fogging are likely to be caused.

An inorganic fine powder used in the present invention, in order to impart good fluidity to the toner, has a specific surface area measured by BET method using nitrogen adsorption of preferably 20 $m^2/g$ or larger and 350 $m^2/g$ or smaller, and more preferably 25 $m^2/g$ or larger and 300 $m^2/g$ or smaller. The specific surface area is calculated using BET multi-point method by making nitrogen gas adsorbed on a sample surface by using a specific surface area analyzer Autosorb 1 (manufactured by Yuasa Ionics Inc.), according to BET method.

In the toner according to the present invention, further addition of inorganic or organic nearly spherical fine particles to the toner particles for the purpose of the improvement in the cleaning property and the like is also one preferred embodiment, the fine particles having a number-average particle diameter of primary particles of exceeding 30 nm, and more preferably 50 nm or larger. For example, spherical silica particles, spherical polymethylsilsesquioxane particles, spherical resin particles and the like can be used.

Small amounts of other additives may further be added as developability-improving agents, in the range substantially not imparting the adverse effect, to the toner according to the present invention, the additives being, for example, lubricant powders such as fluororesin powder, zinc stearate powder and polyvinylidene fluoride powder; abrasive agents such as cerium oxide powder, silicon carbide powder and strontium titanate powder; fluidity-imparting agents such as titanium oxide powder and aluminum oxide powder; caking-preventing agents; and organic fine particles and inorganic fine particles having a reverse polarity. The surface of these additives may be subjected to a hydrophobization treatment to be used.

Then, methods of measuring the physical properties of the toner according to the present invention will be described.

(1) Endothermic Peak Top Temperatures of Ester Wax, Hydrocarbon Wax and Toner

The endothermic peak top temperatures of an ester wax, a hydrocarbon wax and a toner are peak tops of endothermic peaks as measured by DSC. The peak tops of endothermic peaks are measured according to ASTM D 3417-99. For example, DSC-7 manufactured by PerkinElmer Inc., DSC2920 manufactured by TA Instrument Co., Ltd. and Q1000 manufactured by TA Instrument Co., Ltd. can be used for these measurements. The temperature correction of the apparatus detection section uses melting points of indium and zinc; and the correction of the calorific value uses the heat of fusion of indium. An aluminum pan is used for a measurement sample, and a blank pan is set and measured for reference.

(2) Average Particle Diameter and Particle Size Distribution of Toner

The weight-average particle diameter and the particle size distribution of the toner according to the present invention can be measured by various types of methods using a Coulter Counter TA-II or a Coulter Multisizer (manufactured by Coulter Scientific Instruments, Inc.) or the like. In the present invention, a Coulter Multisizer (manufactured by Coulter Scientific Instruments, Inc.) is used, and an interface (manufactured by Nikkaki Bios Co., Ltd.) to output the number distribution and the volume distribution and a PC9801 personal computer (manufactured by NEC Corp.) are connected thereto. As an electrolytic solution, a 1% NaCl aqueous solution prepared by using a first-class grade sodium chloride is used. Such an electrolytic solution usable is, for example, ISOTON R-II (manufactured by Coulter Scientific Japan Co., Ltd.).

The measurement procedure is as follows. 0.1 to 5 ml of a surfactant, preferably an alkylbenzenesulfonate salt, as a dispersant is added to 100 to 150 ml of the above electrolytic solution, and 2 to 20 mg of a measurement sample is further added. The electrolytic solution containing the sample suspended therein is subjected to a dispersion treatment using an ultrasonic disperser for about 1 to 3 min; and the number of toner particles of 2 μm or larger is measured by the Coulter Multisizer using an aperture of 100 μm, and the number distribution is calculated. Based thereon, the weight-average particle diameter is determined.

(3) Composition Distribution and Molecular Weight of Ester Wax

The composition distribution of an ester wax is calculated by determining a peak area of each component by using gas chromatography (GC) and determining a ratio thereof to the total peak area.

Specifically, GC-17A (manufactured by Shimadzu Corp.) is used as gas chromatography (GC). 10 mg of a sample is added to 1 ml of toluene, and heated and dissolved for 20 min in a 80° C.-constant-temperature bath. Then, 1 μl of this solution is injected in a GC apparatus equipped with an on-column injector. Ultra Alloy-1 (HT) of 0.5 mm in diameter× 10 m in length is used as the column. The column is heated first at a temperature-rise rate of 40° C./min from 40° C. to 200° C., further at 15° C./min to 350° C., and then at a temperature-rise rate of 7° C./min to 450° C. He gas as a carrier gas is made to flow under the pressure condition of 50 kPa.

A compound can be identified by separately injecting an ester wax having a known structure and comparing the same effluent times, or introducing a gasified component to a mass spectrometer (mass analyzer) and analyzing the spectrum.

The molecular weight of an ester wax can be determined by a calculation from the structure determined in the above method.

Then, one example of an image-forming apparatus capable of suitably using the toner according to the present invention will be described specifically by way of FIGURE. In FIGURE, reference numeral 100 is a photosensitive drum; and in its circumference, a primary charging roller 117, a developing assembly 140 having a developing sleeve 102, a transferring charging roller 114, a cleaner 116, a resister roller 124 and the like are installed. The photosensitive drum 100 is charged, for example, at −600V by the primary charging roller 117 (applied voltage is, for example, an alternating-current voltage of 1.85 kVpp and a direct-current voltage of −620 Vdc). Then, a laser light 123 is irradiated on the photosensitive drum 100 by a laser generating apparatus 121 to carry out exposure to thereby form electrostatic latent images corresponding to target images. The electrostatic latent images on the photosensitive drum 100 are developed with a one-component toner by the developing assembly 140 to thereby obtain toner images; and the toner images are transferred on a transfer material by a transferring roller 114 contacting with the photosensitive drum through the transfer material. The transfer material mounting the toner images is transported to a fixing assembly 126 by a transport belt 125 and the like and the toner images are fixed on the transfer material. The toner being partially left remaining on the photosensitive drum is cleaned by the cleaner 116.

Here, an image-forming apparatus using a magnetic one-component jumping development is illustrated, but the toner according to the present invention may be a toner or a non-toner, or a toner used in either of a one-component development system and a two-component development system. A toner may further be a toner used in either method of a jumping development and a contact development.

EXAMPLES

Hereinafter, the present invention will be described in more detail by way of Production Examples and Examples, but these do not limit the present invention at all. Here, parts in the following every blend indicate parts by mass.

<Production of an Ester Wax 1>

300 parts by mol of benzene, 200 parts by mol of docosanol (behenyl alcohol), 100 parts by mol of dodecanoic diacid, and further 10 parts by mol of p-toluenesulfonic acid were added to a reactor equipped with a Dimroth condenser, a Dean-Stark water separator and a thermometer, and sufficiently stirred and dissolved, and thereafter refluxed for 6 hours; and thereafter, a valve of the water separator was opened and azeotropic distillation was carried out. After the azeotropic distillation, the resultant was sufficiently cleaned with sodium hydrogencarbonate, and thereafter dried to thereby distil away benzene. An obtained product was recrystallized, and thereafter cleaned and refined to thereby obtain an ester compound D-22.

An ester compound D-20 was similarly obtained by altering docosanol to eicosanol.

An ester compound D-18 was further obtained by altering docosanol to octadecanol.

These D-18, D-20 and D-22 were melted and mixed in proportions described in Table 1, and cooled and thereafter disintegrated to thereby obtain an ester wax 1. The composition proportion measured by gas chromatography (GC) is collectively shown in Table 1.

TABLE 1

Table of the Composition of Ester Wax 1

| | x Value | The Number of Carbon Atoms in $R_1$ and $R_2$ | Molecular Weight | Mixing Proportion | GC Composition Proportion |
|---|---|---|---|---|---|
| D-18 | 8 | R1 = 18<br>R2 = 18 | 707.2 | 5% | 5% |
| D-20 | 8 | R1 = 20<br>R2 = 20 | 763.3 | 31% | 31% |
| D-22 | 8 | R1 = 22<br>R2 = 22 | 819.4 | 64% | 64% |

<Production of Ester Waxes 2 to 16, and 19 to 21, and 24 and 25>

Ester waxes 2 to 16, and 19 to 21, and 24 and 25 were produced as in the production of the ester wax 1, except for altering docosanol and dodecanoic diacid in the production of the ester wax 1 to compounds shown in Table 2. The physical properties of each ester wax are shown in Table 2.

<Production of an Ester Wax 17>

300 parts by mol of benzene, 200 parts by mol of docosanol (behenyl alcohol), 200 parts by mol of docosanoic acid (behenic acid), and further 10 parts by mol of p-toluenesulfonic acid were added to a reactor equipped with a Dimroth condenser, a Dean-Stark water separator and a thermometer, and sufficiently stirred and dissolved, and thereafter refluxed for 6 hours; and thereafter, a valve of the water separator was opened and azeotropic distillation was carried out. After the azeotropic distillation, the resultant was sufficiently cleaned with sodium hydrogencarbonate, and thereafter dried to thereby distil away benzene. An obtained product was recrystallized, and thereafter cleaned and refined to thereby obtain an ester wax 17 (behenyl behenate). The physical properties of the obtained ester wax 17 are shown in Table 2.

<Production of an Ester Wax 18>

An ester compound C-20 was obtained as in the production of an ester wax 17, except for altering docosanol to eicosanol and altering docosanoic acid to icosanoic acid (arachidic acid).

An ester compound C-18 was further obtained as in the production of an ester wax 17, except for altering docosanol to octadecanol and altering docosanoic acid to octadecanoic acid (stearic acid).

These ester waxes 17, C-20 and C-22 were melted and mixed in proportions described in Table 3, and cooled and thereafter disintegrated to thereby obtain an ester wax 18. The composition proportion measured by gas chromatography (GC) is collectively shown in Table 2.

<Production of an Ester Wax 22>

An ester wax 22 was produced as in the production of the ester wax 1, except for altering dodecanoic diacid in the production of the ester wax 1 to terephthalic acid. The composition of the ester wax 22 is shown in Table 3, and the physical properties are shown in Table 2.

<Production of an Ester Wax 23>

An ester wax 23 was produced as in the production of the ester wax 1, except for altering 200 parts by mol of docosanol to 100 parts by mol of glycerol and altering 100 parts by mol of dodecanoic diacid to 300 parts by mol of docosanoic acid in the production of the ester wax 1. The composition of the ester wax 23 is shown in Table 3, and the physical properties are shown in Table 2.

TABLE 2

Physical Properties of the Ester Waxes

| | Structural Formula | x Value | The Number of Carbon Atoms in $R_1$ and $R_2$, or $R_3$ and $R_4$ | Maximum Ester Compound Proportion | Melting Point | Proportion Satisfying $0.8 \times M1 \leq M \leq 1.2 \times M1$ |
|---|---|---|---|---|---|---|
| Ester Wax 1 | 1 | 8 | R1 = 22<br>R2 = 22 | 64% | 73.5° C. | 100% |
| Ester Wax 2 | 1 | 10 | R1 = 22<br>R2 = 22 | 64% | 78.5° C. | 100% |
| Ester Wax 3 | 2 | 8 | R3 = 22<br>R4 = 22 | 64% | 74.2° C. | 100% |
| Ester Wax 4 | 2 | 9 | R3 = 22<br>R4 = 22 | 64% | 75.0° C. | 100% |
| Ester Wax 5 | 2 | 10 | R3 = 22<br>R4 = 22 | 64% | 78.5° C. | 100% |
| Ester Wax 6 | 1 | 8 | R1 = 22<br>R2 = 22 | 40% | 71.5° C. | 90% |
| Ester Wax 7 | 1 | 8 | R1 = 16<br>R2 = 16 | 80% | 65.0° C. | 100% |
| Ester Wax 8 | 2 | 9 | R3 = 26<br>R4 = 26 | 40% | 80.0° C. | 90% |
| Ester Wax 9 | 2 | 9 | R3 = 22<br>R4 = 22 | 80% | 77.1° C. | 100% |
| Ester Wax 10 | 1 | 8 | R1 = 22<br>R2 = 22 | 62% | 73.1° C. | 90% |
| Ester Wax 11 | 1 | 8 | R1 = 22<br>R2 = 22 | 62% | 72.4° C. | 85% |
| Ester Wax 12 | 1 | 8 | R1 = 24<br>R2 = 24 | 35% | 70.2° C. | 90% |
| Ester Wax 13 | 1 | 8 | R1 = 16<br>R2 = 16 | 90% | 67.2° C. | 100% |
| Ester Wax 14 | 2 | 9 | R3 = 26<br>R4 = 26 | 35% | 76.6° C. | 90% |
| Ester Wax 15 | 2 | 9 | R3 = 20<br>R4 = 20 | 90% | 72.7° C. | 100% |
| Ester Wax 16 | 2 | 9 | R3 = 20<br>R4 = 20 | 100% | 73.1° C. | 100% |

TABLE 2-continued

Physical Properties of the Ester Waxes

| | Structural Formula | x Value | The Number of Carbon Atoms in $R_1$ and $R_2$, or $R_3$ and $R_4$ | Maximum Ester Compound Proportion | Melting Point | Proportion Satisfying $0.8 \times M1 \leq M \leq 1.2 \times M1$ |
|---|---|---|---|---|---|---|
| Ester Wax 17 | Behenyl behenate | | | 100% | 73.8° C. | 100% |
| Ester Wax 18 | Behenyl behenate | | | 64% | 72.2° C. | 100% |
| Ester Wax 19 | 2 | 2 | R3 = 18<br>R4 = 18 | 64% | 75.6° C. | 100% |
| Ester Wax 20 | 2 | 7 | R3 = 22<br>R4 = 22 | 64% | 73.9° C. | 100% |
| Ester Wax 21 | 2 | 11 | R3 = 22<br>R4 = 22 | 64% | 78.4° C. | 100% |
| Ester Wax 22 | Terephthalic acid | | R1 = 22<br>R2 = 22 | 64% | 74.0° C. | 100% |
| Ester Wax 23 | Glycerol | | R1 = 22<br>R2 = 22 | 64% | 80.0° C. | 100% |
| Ester Wax 24 | 1 | 8 | R1 = 14<br>R2 = 14 | 80% | 61.4° C. | 100% |
| Ester Wax 25 | 2 | 9 | R3 = 28<br>R4 = 28 | 40% | 83.4° C. | 90% |

TABLE 3

Table of Compositions of the Ester Waxes 22 and 23

| | Molecular Weight | Mixing Proportion | GC Composition Proportion |
|---|---|---|---|
| Ester Wax 22 | 671.4 | 5% | 5% |
| | 727.2 | 31% | 31% |
| | 783.3 | 64% | 64% |
| Ester Wax 23 | 891.5 | 5% | 5% |
| | 975.7 | 31% | 31% |
| | 1059.8 | 64% | 64% |

The physical properties of the hydrocarbon waxes used in the present invention are shown in Table 4.

TABLE 4

List of the Hydrocarbon Waxes

| | | Melting Point | Full Width at Half Maximum |
|---|---|---|---|
| Hydrocarbon Wax 1 | Fischer-Tropsch | 78.1° C. | 3.2° C. |
| Hydrocarbon Wax 2 | Parafin Wax | 76.4° C. | 5.0° C. |
| Hydrocarbon Wax 3 | Parafin Wax | 75.4° C. | 6.2° C. |
| Hydrocarbon Wax 4 | Parafin Wax | 70.1° C. | 9.5° C. |
| Hydrocarbon Wax 5 | Polyethylene Wax | 92.2° C. | 4.8° C. |

<Production 1 of an Amorphous Polyester Resin>

Monomer components other than trimellitic anhydride shown in Table 5 were put in molar ratios shown in Table 5 in a reaction tank equipped with a cooling tube, a stirrer and a nitrogen introducing tube, and allowed to react at 230° C. for 10 hours under a nitrogen gas flow while water produced was being distilled away. At this time, a titanium-based catalyst (titanium dihydroxybis(triethanolaminate)) as a catalyst was added in 0.25 parts with respect to 100 parts of the total amount of the monomers of acids and alcohols.

Then, the reaction system was allowed to react under a reduced pressure of 20 mmHg, and cooled at 180° C. at the time point when the acid value became 0.5 mgKOH/g or lower; trimellitic anhydride was then added in a molar ratio shown in Table 5; and the reaction system was taken out after 2 hours of the reaction in a closed state at normal pressure, cooled to room temperature, and crushed to thereby obtain an amorphous polyester resin 1. The physical properties of the obtained amorphous polyester resin 1 are shown in Table 5.

<Production Examples 2 to 7 of Amorphous Polyester Resins>

Amorphous polyester resins 2 to 7 were obtained as in Production Example 1 of the amorphous polyester resin, except for altering to monomer components and blends as shown in Table 5. The compositions and the physical properties of the obtained amorphous polyester resins 2 to 7 are shown in Table 5.

TABLE 5

List of Polyesters

| | BPA-PO(2) | BPA-PO(3) | BPA-EO(2) | BPA | TPA | TMA | Tg (° C.) | Mp | Average Addition Molar Number of Propylene Oxide |
|---|---|---|---|---|---|---|---|---|---|
| Amorphous Polyester Resin 1 | 100 | — | — | — | 100 | 20 | 85 | 10000 | 2.0 |
| Amorphous Polyester Resin 2 | 90 | — | 10 | — | 100 | 20 | 80 | 10000 | 1.8 |
| Amorphous Polyester Resin 3 | 75 | 25 | — | — | 100 | 25 | 80 | 10000 | 2.3 |
| Amorphous Polyester Resin 4 | 25 | 75 | — | — | 100 | 20 | 75 | 10000 | 2.8 |
| Amorphous Polyester Resin 5 | 80 | — | 20 | — | 100 | 20 | 75 | 10000 | 1.6 |

TABLE 5-continued

| List of Polyesters | | | | | | | | | |
|---|---|---|---|---|---|---|---|---|---|
| | BPA-PO(2) | BPA-PO(3) | BPA-EO(2) | BPA | TPA | TMA | Tg (° C.) | Mp | Average Addition Molar Number of Propylene Oxide |
| Amorphous Polyester Resin 6 | 80 | — | — | 20 | 100 | 25 | 85 | 10000 | 1.6 |
| Amorphous Polyester Resin 7 | 70 | — | — | 30 | 100 | 20 | 90 | 7000 | 1.4 |

BPA-PO(2): bisphenol A propylene oxide-2 mol adduct
BPA-PO(3): bisphenol A propylene oxide-3 mol adduct
BPA-EO(2): bisphenol A ethylene oxide-2 mol adduct
TPA: terephthalic acid
TMA: trimellitic anhydride
Tg: glass transition temperature (° C.)
Mp: peak molecular weight Here, numerals in the Table indicate molar ratios.

<Production of a Magnetic Powder>

In a ferrous sulfate aqueous solution, a caustic soda solution of 1.1 equivalent weight to iron element, $P_2O_5$ in an amount of 0.12% by mass in terms of phosphorus element to iron element, and $SiO_2$ in an amount of 0.55% by mass in terms of silicon element to iron element were mixed to thereby prepare an aqueous solution containing ferrous hydroxide. The pH of the aqueous solution was made 7.5, and the oxidation reaction was carried out at 85° C. while air was being blown in to thereby prepare a slurry liquid having seed crystals.

Then, a ferrous sulfate aqueous solution of 1.1 equivalent weight to the initial alkali amount (the sodium component of the caustic soda) was added to the slurry liquid; and the oxidation reaction was progressed while the pH of the slurry liquid was maintained at 7.6 and air was being blown in, to thereby obtain a slurry liquid containing magnetic iron oxide. The slurry liquid was filtered and cleaned, and then the hydrous slurry liquid was once taken out. At this time, the hydrous sample was collected in a small amount, and measured for the moisture content. Then, the hydrous sample was charged in another aqueous medium without being dried; the slurry was redispersed by a pin mill while the slurry was circulated under stirring, and the pH of the redispersed liquid was regulated at about 4.8. Then, 1.5 parts of n-hexyltrimethoxysilane with respect to 100 parts of the magnetic iron oxide (the amount of the magnetic iron oxide was calculated as a value obtained by subtracting the moisture content from the hydrous sample) was added under stirring and the hydrolysis was carried out. Thereafter, the slurry was dispersed by a pin mill while being sufficiently stirred and being circulated, and the pH of the dispersed liquid was made to be 8.6 and a hydrophobization treatment was carried out. An obtained hydrophobized magnetic powder was filtered by a filter press, cleaned with a large amount of water, and thereafter dried at 100° C. for 15 min and at 90° C. for 30 min; and obtained particles were subjected to a disintegration treatment to thereby obtain a magnetic powder 1 having a volume-average particle diameter (D3) of 0.21 μm.

<Production of a Toner 1>

450 parts of a 0.1 mol/L-$Na_3PO_4$ aqueous solution was charged in 720 parts of ion-exchange water, and heated at 60° C.; thereafter, 67.7 parts of a 1.0 mol/L-$CaCl_2$ aqueous solution was added to thereby obtain an aqueous medium containing a dispersant.

Styrene . . . 78.0 parts n-Butyl acrylate . . . 22.0 parts

Divinylbenzene . . . 0.48 parts

Iron complex of a monoazo dye (T-77, manufactured by Hodogaya Chemical Co., Ltd.) . . . 1.5 parts Magnetic powder 1 . . . 90.0 parts Polyester resin 1 . . . 5.0 parts The above formulation was homogeneously dispersed and mixed using an attritor (Mitsui Miike Kakoki K.K.) to thereby obtain a monomer composition. The monomer composition was heated at 60° C.; 10 parts of the ester wax 1 and 10 parts of the hydrocarbon wax 1 were added thereto and mixed and dissolved, and thereafter, 4.5 parts of a polymerization initiator, 2,2'-azobis(2,4-dimethylvaleronitrile) was dissolved.

The monomer composition was charged in the above aqueous medium, and stirred at 60° C. in a $N_2$ atmosphere at 12,000 rpm for 10 min by a T.K. Homo Mixer (Tokushu Kika Kogyo K.K.) to be thereby granulated. Thereafter, the resultant was allowed to react at 70° C. for 5 hours under stirring by a paddle stirring blade. Thereafter, the suspension liquid was heated to 100° C., maintained for 1 hour, and then cooled to 40° C. at a temperature-fall rate of 1.5° C./min and the reaction was terminated. After the reaction termination, the suspension liquid was cooled, cleaned by adding hydrochloric acid, and then filtered and dried to thereby obtain toner particles 1.

100 Parts of the toner particles 1 and 0.8 parts of a hydrophobic silica having a number-average particle diameter of primary particles of 12 nm were mixed by a Henschel mixer (Mitsui Miike Kakoki K.K.) to thereby obtain a toner 1 of 7.8 μm in weight-average particle diameter (D4). The physical properties of the toner 1 are shown in Table 6.

<Production of Toners 2 to 48>

Toners 2 to 48 were obtained as in the production of the toner 1, except for altering the blend in the production of the toner 1 to blends of ester waxes, hydrocarbon waxes and polyester resins shown in Table 6 and further altering the temperature-fall rate after the holding of 100° C. for 1 hour to temperature-fall rates shown in Table 6, respectively. The compositions and the physical properties of the toners 2 to 48 are shown in Table 6.

TABLE 6

List of Toners

| Toner | Ester Wax Kind | Ester Wax Amount Added (parts) | Hydrocarbon Wax Kind | Hydrocarbon Wax Amount Added (parts) | Polyester Resin | Temperature-Fall Rate | Weight-Average Particle Diameter (D4) | Tw-Tt |
|---|---|---|---|---|---|---|---|---|
| Toner 1 | Ester Wax 1 | 10 parts | Hydrocarbon Wax 1 | 10 parts | Polyester Resin 1 | 1.5° C./min | 7.8 μm | 6.1° C. |
| Toner 2 | Ester Wax 2 | 10 parts | Hydrocarbon Wax 1 | 10 parts | Polyester Resin 1 | 1.5° C./min | 7.3 μm | 4.5° C. |
| Toner 3 | Ester Wax 3 | 10 parts | Hydrocarbon Wax 1 | 10 parts | Polyester Resin 1 | 1.5° C./min | 7.6 μm | 4.2° C. |
| Toner 4 | Ester Wax 4 | 10 parts | Hydrocarbon Wax 1 | 10 parts | Polyester Resin 1 | 0.3° C./min | 7.4 μm | 6.3° C. |
| Toner 5 | Ester Wax 5 | 10 parts | Hydrocarbon Wax 1 | 10 parts | Polyester Resin 1 | 3.0° C./min | 7.9 μm | 4.7° C. |
| Toner 6 | Ester Wax 6 | 10 parts | Hydrocarbon Wax 1 | 10 parts | Polyester Resin 1 | 1.5° C./min | 8.0 μm | 8.0° C. |
| Toner 7 | Ester Wax 7 | 10 parts | Hydrocarbon Wax 1 | 10 parts | Polyester Resin 1 | 0.3° C./min | 7.2 μm | 8.0° C. |
| Toner 8 | Ester Wax 8 | 10 parts | Hydrocarbon Wax 1 | 10 parts | Polyester Resin 1 | 3.0° C./min | 7.5 μm | 3.0° C. |
| Toner 9 | Ester Wax 9 | 10 parts | Hydrocarbon Wax 1 | 10 parts | Polyester Resin 1 | 1.5° C./min | 7.4 μm | 3.0° C. |
| Toner 10 | Ester Wax 1 | 10 parts | Hydrocarbon Wax 2 | 10 parts | Polyester Resin 1 | 1.5° C./min | 8.1 μm | 6.8° C. |
| Toner 11 | Ester Wax 1 | 10 parts | Hydrocarbon Wax 3 | 10 parts | Polyester Resin 1 | 1.5° C./min | 7.2 μm | 7.2° C. |
| Toner 12 | Ester Wax 10 | 10 parts | Hydrocarbon Wax 3 | 10 parts | Polyester Resin 1 | 1.5° C./min | 7.5 μm | 7.4° C. |
| Toner 13 | Ester Wax 11 | 10 parts | Hydrocarbon Wax 3 | 10 parts | Polyester Resin 1 | 1.5° C./min | 8.1 μm | 7.5° C. |
| Toner 14 | Ester Wax 11 | 20 parts | Hydrocarbon Wax 3 | 10 parts | Polyester Resin 1 | 1.5° C./min | 8.0 μm | 6.5° C. |
| Toner 15 | Ester Wax 11 | 25 parts | Hydrocarbon Wax 3 | 10 parts | Polyester Resin 1 | 1.5° C./min | 7.4 μm | 6.8° C. |
| Toner 16 | Ester Wax 11 | 35 parts | Hydrocarbon Wax 3 | 10 parts | Polyester Resin 1 | 1.5° C./min | 7.8 μm | 6.1° C. |
| Toner 17 | Ester Wax 11 | 10 parts | Hydrocarbon Wax 3 | 20 parts | Polyester Resin 1 | 1.5° C./min | 7.8 μm | 3.6° C. |
| Toner 18 | Ester Wax 11 | 5 parts | Hydrocarbon Wax 3 | 5 parts | Polyester Resin 1 | 1.5° C./min | 7.6 μm | 6.1° C. |
| Toner 19 | Ester Wax 11 | 3 parts | Hydrocarbon Wax 3 | 2 parts | Polyester Resin 1 | 1.5° C./min | 7.8 μm | 5.8° C. |
| Toner 20 | Ester Wax 11 | 2 parts | Hydrocarbon Wax 3 | 2 parts | Polyester Resin 1 | 1.5° C./min | 7.7 μm | 5.9° C. |
| Toner 21 | Ester Wax 11 | 10 parts | Hydrocarbon Wax 3 | 10 parts | Polyester Resin 2 | 1.5° C./min | 7.2 μm | 7.5° C. |
| Toner 22 | Ester Wax 11 | 10 parts | Hydrocarbon Wax 3 | 10 parts | Polyester Resin 3 | 1.5° C./min | 7.1 μm | 7.5° C. |
| Toner 23 | Ester Wax 11 | 10 parts | Hydrocarbon Wax 3 | 10 parts | Polyester Resin 4 | 1.5° C./min | 7.4 μm | 7.5° C. |
| Toner 24 | Ester Wax 11 | 10 parts | Hydrocarbon Wax 3 | 10 parts | Polyester Resin 5 | 1.5° C./min | 7.8 μm | 7.5° C. |
| Toner 25 | Ester Wax 11 | 10 parts | Hydrocarbon Wax 3 | 10 parts | Polyester Resin 6 | 1.5° C./min | 7.5 μm | 7.5° C. |
| Toner 26 | Ester Wax 11 | 10 parts | Hydrocarbon Wax 3 | 10 parts | Polyester Resin 7 | 1.5° C./min | 7.5 μm | 7.5° C. |
| Toner 27 | Ester Wax 12 | 10 parts | Hydrocarbon Wax 1 | 10 parts | Polyester Resin 1 | 1.5° C./min | 7.4 μm | 8.0° C. |
| Toner 28 | Ester Wax 13 | 10 parts | Hydrocarbon Wax 1 | 10 parts | Polyester Resin 1 | 1.5° C./min | 7.8 μm | 7.8° C. |
| Toner 29 | Ester Wax 14 | 10 parts | Hydrocarbon Wax 1 | 10 parts | Polyester Resin 1 | 1.5° C./min | 7.7 μm | 3.6° C. |
| Toner 30 | Ester Wax 15 | 10 parts | Hydrocarbon Wax 1 | 10 parts | Polyester Resin 1 | 1.5° C./min | 7.1 μm | 3.0° C. |
| Toner 31 | Ester Wax 16 | 10 parts | Hydrocarbon Wax 1 | 10 parts | Polyester Resin 1 | 1.5° C./min | 7.3 μm | 1.5° C. |
| Toner 32 | Ester Wax 17 | 10 parts | Hydrocarbon Wax 1 | 10 parts | Polyester Resin 1 | 1.5° C./min | 7.2 μm | 1.2° C. |
| Toner 33 | Ester Wax 6 | 10 parts | Hydrocarbon Wax 1 | 10 parts | Polyester Resin 1 | 0.1° C./min | 7.4 μm | 8.4° C. |
| Toner 34 | Ester Wax 7 | 10 parts | Hydrocarbon Wax 1 | 10 parts | Polyester Resin 1 | 0.1° C./min | 7.6 μm | 8.2° C. |
| Toner 35 | Ester Wax 8 | 10 parts | Hydrocarbon Wax 1 | 10 parts | Polyester Resin 1 | 5.0° C./min | 7.7 μm | 2.6° C. |
| Toner 36 | Ester Wax 9 | 10 parts | Hydrocarbon Wax 1 | 10 parts | Polyester Resin 1 | 5.0° C./min | 7.7 μm | 2.7° C. |
| Toner 37 | Ester Wax 7 | 10 parts | Hydrocarbon Wax 4 | 10 parts | Polyester Resin 1 | 1.5° C./min | 7.5 μm | 8.8° C. |
| Toner 38 | Ester Wax 8 | 10 parts | Hydrocarbon Wax 5 | 10 parts | Polyester Resin 1 | 1.5° C./min | 7.4 μm | two peaks |
| Toner 39 | Ester Wax 18 | 20 parts | Hydrocarbon Wax 1 | — | Polyester Resin 1 | 1.5° C./min | 7.6 μm | 0.8° C. |
| Toner 40 | Ester Wax 1 | 20 parts | Hydrocarbon Wax 1 | — | Polyester Resin 1 | 1.5° C./min | 7.5 μm | 0.4° C. |
| Toner 41 | — | 20 parts | Hydrocarbon Wax 1 | — | Polyester Resin 1 | 1.5° C./min | 7.1 μm | 0.6° C. |
| Toner 42 | Ester Wax 19 | 10 parts | Hydrocarbon Wax 1 | 10 parts | Polyester Resin 1 | 1.5° C./min | 8.2 μm | two peaks |
| Toner 43 | Ester Wax 20 | 10 parts | Hydrocarbon Wax 1 | 10 parts | Polyester Resin 1 | 1.5° C./min | 7.5 μm | 2.2° C. |
| Toner 44 | Ester Wax 21 | 10 parts | Hydrocarbon Wax 1 | 10 parts | Polyester Resin 1 | 1.5° C./min | 7.2 μm | 2.7° C. |
| Toner 45 | Ester Wax 22 | 10 parts | Hydrocarbon Wax 1 | 10 parts | Polyester Resin 1 | 1.5° C./min | 7.3 μm | two peaks |
| Toner 46 | Ester Wax 23 | 10 parts | Hydrocarbon Wax 1 | 10 parts | Polyester Resin 1 | 1.5° C./min | 7.8 μm | two peaks |
| Toner 47 | Ester Wax 24 | 10 parts | Hydrocarbon Wax 1 | 10 parts | Polyester Resin 1 | 1.5° C./min | 7.9 μm | 9.2° C. |
| Toner 48 | Ester Wax 25 | 10 parts | Hydrocarbon Wax 1 | 10 parts | Polyester Resin 1 | 1.5° C./min | 8.0 μm | 2.4° C. |

* In Table, two peaks in the Tw-Tt column means that respective melting points of an ester wax and a hydrocarbon wax were observed.

Example 1

Image-Forming Apparatus

By using Laser Jet P1006 (manufactured by Hewlett-Packard Development Co.) as an image-forming apparatus, and using the toner 1, an image-forming test of 2,000 sheets printing horizontal lines of 4% in printing rate in a continuous mode was carried out under the normal temperature-normal humidity environment (23° C./60% RH). Here, during image-forming endurance, the image-forming test was carried out in a thick-paper mode. The thick-paper mode is a mode in which the temperature of a fixing assembly is set high, and an evaluation mode severe to the volatilization of the wax component.

After the finish of the image-forming test, in order to check whether any density reduction at both ends of images is caused, halftone images were printed out so that the reflection density of the image central part became 0.6, and the density difference between the image central part and ends of images was checked (first time). Further, the cartridge was replaced by a new one, and the similar image-forming test was carried out, and the density difference between the image central part and ends of images was finally checked (second time).

Here, as the recording medium, an A4 paper of 75 g/m$^2$ was used. As a result, no density reduction at both ends of images before and after the durability test was caused, and high-density images could be obtained. The evaluation results are shown in Table 7.

Further, a fixing test was carried out under the following condition.

An Extra 80 g-paper was used as the medium, and the development bias was set so that the image density of halftone images became 0.60 to 0.65. Then, a fixing assembly was cooled to room temperature; the heater temperature of the fixing assembly was set (hereinafter, called a fixing temperature), and after 8 sec after the fixing assembly started to be energized, images were paper-passed and fixed. Thereafter, the fixed images were 10 times rubbed with a lens-cleaning paper on which a load of g/cm$^2$ (0.49 N/cm$^2$) was applied, and a temperature at which the density reduction rate of the fixed images after the rubbing became 10% was defined as a fixing temperature. As a result, the fixing temperature of the toner 1 was 180° C.

The evaluation methods for evaluation items carried out in the Examples of the present invention and Comparative Examples and the determination criteria for evaluation will be described below.

<Image Density>

The image density was acquired by forming a solid image part and measuring the density of the solid image with a Macbeth reflection densitometer (manufactured by Gretag-Macbeth LLC).

<Density at Both Ends of Images>

The density reduction at both ends of images was evaluated according to the following criteria by using the density difference between the average density at both ends of images and the image central part.

A: the density difference is smaller than 0.05.

B: the density difference is 0.05 or larger and smaller than 0.10.

C: the density difference is 0.10 or larger and smaller than 0.15.

D: the density difference is 0.15 or larger.

<Preservability>

The preservability was evaluated according to the following criteria after 10 g of a toner was put in a polycup and kept at 50° C. for 5 days.

A: no aggregation of the toner is caused.

B: aggregation of the toner is slightly caused.

C: aggregation of the toner is caused, but the toner is at a level of being able to be used with no problem.

D: aggregation of the toner is remarkably caused, and the toner is at a level of being unable to be used.

Examples 2 to 26

Image-forming tests were carried out as in Example 1, except for altering the toner 1 in Example 1 to the toners 2 to 26, respectively. As a result, any of those toners could provide images having a high image density before and after the durability test, and for those toners, the density reduction at both ends of the images, the fixing property and the preservability were at a non-problematic level. The evaluation results are shown in Table 7.

Comparative Examples 1 to 22

Image-forming tests were carried out as in Example 1, except for altering the toner in Example 1 to the toners 27 to 48, respectively. As a result, any of those toners could provide images having a high image density before and after the durability test, but those toners were not at a level suitable for practical use in terms of any of the density reduction at both ends of the images, the fixing property and the preservability. The evaluation results are shown in Table 7.

TABLE 7

| | | | After Finish of 2,000 Sheets Image Forming (First Time) | | After Finish of 4,000 Sheets Image Forming (Second Time) | | | |
|---|---|---|---|---|---|---|---|---|
| | Toner | Initial Image Density | Image Density | Density of Image Both Ends | Image Density | Density of Image Both Ends | Fixing temperature | Preservability |
| Example 1 | Toner 1 | 1.52 | 1.45 | A | 1.45 | A | 180 | A |
| Example 2 | Toner 2 | 1.51 | 1.45 | A | 1.45 | A | 185 | A |
| Example 3 | Toner 3 | 1.52 | 1.46 | A | 1.45 | A | 180 | A |
| Example 4 | Toner 4 | 1.52 | 1.45 | A | 1.46 | A | 180 | A |
| Example 5 | Toner 5 | 1.50 | 1.45 | A | 1.45 | A | 185 | A |
| Example 6 | Toner 6 | 1.49 | 1.44 | A | 1.43 | A | 180 | B |
| Example 7 | Toner 7 | 1.46 | 1.42 | A | 1.41 | A | 175 | B |
| Example 8 | Toner 8 | 1.51 | 1.45 | A | 1.46 | B | 185 | A |
| Example 9 | Toner 9 | 1.52 | 1.46 | A | 1.44 | B | 185 | A |
| Example 10 | Toner 10 | 1.50 | 1.44 | A | 1.43 | A | 185 | A |
| Example 11 | Toner 11 | 1.48 | 1.43 | B | 1.42 | B | 185 | A |
| Example 12 | Toner 12 | 1.47 | 1.42 | B | 1.43 | B | 185 | A |
| Example 13 | Toner 13 | 1.48 | 1.43 | B | 1.43 | C | 185 | A |
| Example 14 | Toner 14 | 1.44 | 1.39 | B | 1.39 | C | 175 | A |
| Example 15 | Toner 15 | 1.42 | 1.37 | C | 1.36 | C | 170 | A |
| Example 16 | Toner 16 | 1.39 | 1.32 | C | 1.31 | C | 160 | B |
| Example 17 | Toner 17 | 1.42 | 1.38 | C | 1.36 | C | 185 | A |
| Example 18 | Toner 18 | 1.54 | 1.48 | B | 1.47 | C | 190 | A |
| Example 19 | Toner 19 | 1.55 | 1.49 | B | 1.48 | B | 195 | A |
| Example 20 | Toner 20 | 1.57 | 1.51 | A | 1.51 | B | 200 | A |
| Example 21 | Toner 21 | 1.46 | 1.42 | B | 1.41 | C | 185 | A |
| Example 22 | Toner 22 | 1.46 | 1.42 | B | 1.42 | C | 185 | A |
| Example 23 | Toner 23 | 1.45 | 1.41 | C | 1.40 | C | 185 | A |
| Example 24 | Toner 24 | 1.45 | 1.42 | C | 1.40 | C | 185 | A |
| Example 25 | Toner 25 | 1.44 | 1.41 | C | 1.41 | C | 185 | A |
| Example 26 | Toner 26 | 1.44 | 1.38 | C | 1.38 | C | 185 | B |
| Comparative Example 1 | Toner 27 | 1.48 | 1.42 | A | 1.42 | A | 175 | D |
| Comparative Example 2 | Toner 28 | 1.44 | 1.39 | C | 1.38 | D | 175 | B |
| Comparative Example 3 | Toner 29 | 1.47 | 1.41 | A | 1.42 | A | 180 | D |
| Comparative Example 4 | Toner 30 | 1.50 | 1.46 | C | 1.46 | D | 185 | A |

TABLE 7-continued

| | Toner | Initial Image Density | After Finish of 2,000 Sheets Image Forming (First Time) Image Density | Density of Image Both Ends | After Finish of 4,000 Sheets Image Forming (Second Time) Image Density | Density of Image Both Ends | Fixing temperature | Preservability |
|---|---|---|---|---|---|---|---|---|
| Comparative Example 5 | Toner 31 | 1.52 | 1.46 | D | 1.47 | D | 185 | A |
| Comparative Example 6 | Toner 32 | 1.53 | 1.47 | C | 1.46 | D | 185 | A |
| Comparative Example 7 | Toner 33 | 1.48 | 1.42 | A | 1.41 | A | 170 | D |
| Comparative Example 8 | Toner 34 | 1.44 | 1.40 | A | 1.41 | B | 175 | D |
| Comparative Example 9 | Toner 35 | 1.51 | 1.45 | D | 1.44 | D | 190 | A |
| Comparative Example 10 | Toner 36 | 1.52 | 1.46 | C | 1.45 | D | 185 | A |
| Comparative Example 11 | Toner 37 | 1.38 | 1.31 | A | 1.29 | B | 175 | D |
| Comparative Example 12 | Toner 38 | 1.41 | 1.33 | D | 1.32 | D | 190 | A |
| Comparative Example 13 | Toner 39 | 1.51 | 1.45 | C | 1.45 | D | 185 | A |
| Comparative Example 14 | Toner 40 | 1.52 | 1.45 | D | 1.46 | D | 190 | A |
| Comparative Example 15 | Toner 41 | 1.53 | 1.46 | D | 1.44 | D | 190 | A |
| Comparative Example 16 | Toner 42 | 1.49 | 1.43 | C | 1.42 | D | 170 | C |
| Comparative Example 17 | Toner 43 | 1.48 | 1.43 | C | 1.42 | D | 175 | B |
| Comparative Example 18 | Toner 44 | 1.50 | 1.44 | C | 1.43 | A | 190 | A |
| Comparative Example 19 | Toner 45 | 1.42 | 1.32 | D | 1.32 | D | 195 | B |
| Comparative Example 20 | Toner 46 | 1.39 | 1.30 | D | 1.29 | D | 185 | C |
| Comparative Example 21 | Toner 47 | 1.44 | 1.39 | A | 1.38 | A | 165 | D |
| Comparative Example 22 | Toner 48 | 1.51 | 1.43 | C | 1.43 | D | 205 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-183593, filed Sep. 5, 2013, which is hereby incorporated by reference herein in its entirety.

What is claimed is:

1. A toner comprising:

toner particles, each of which comprises a binder resin, a colorant, an ester wax and a hydrocarbon wax; and inorganic fine particles, wherein:

the ester wax comprises an ester compound having a structure represented by the following formula (1) or (2):

$$R_1—CO—O—(CH_2)_x—O—OC—R_2; \quad \text{Formula (1):}$$

or $$R_3—O—OC—(CH_2)_x—CO—O—R_4 \quad \text{Formula (2):}$$

wherein $R_1$ to $R_4$ are an alkyl group; and x is an integer of 8 to 10;

the ester wax comprises, in a composition distribution, an ester compound having a highest abundance rate in an amount of 40% by mass or higher and 80% by mass or lower with respect to a total amount of the ester wax;

when measuring the ester wax and the hydrocarbon wax solely with differential scanning calorimetry, each of the waxes has an endothermic peak respectively, the endothermic peak of the ester wax having a peak top temperature of 65° C. to 80° C., and when measuring the toner with differential scanning calorimetry, the toner has only one endothermic peak derived from the waxes, the only one endothermic peak having a peak top temperature Tt (° C.), wherein:

when measuring the ester wax and the hydrocarbon wax solely with differential scanning calorimetry, among a peak top temperature of the endothermic peak of the ester wax and a peak top temperature of the endothermic peak of the hydrocarbon wax, the lower temperature is defined as Tw (° C.), Tt (° C.) and Tw (° C.) satisfy the following relationship:

$3.0 \leq (Tw-Tt) \leq 8.0$.

2. The toner according to claim 1, wherein the hydrocarbon wax has a peak top temperature of an endothermic peak of 70° C. to 85° C., and a full width at half maximum of the endothermic peak of 5° C. or lower, when measuring the hydrocarbon wax solely with differential scanning calorimetry.

3. The toner according to claim 1, wherein a total abundance rate of ester compounds "A" is 90% by mass or higher with respect to a total amount of the ester wax, wherein the ester compounds "A" are ester compounds having a molecular weight "M" satisfying the following relation:

$$0.8 \times M1 \leq M \leq 1.2 \times M1$$

wherein a molecular weight "M1" represents the molecular weight of an ester compound having a highest abundance rate in the ester wax.

4. The toner according to claim 1, wherein the toner contains 5 parts by mass or more and 40 parts by mass or less of a total amount of the ester wax and the hydrocarbon wax with respect to 100 parts by mass of the binder resin; and a mass ratio of the ester wax to the hydrocarbon wax (ester wax/hydrocarbon wax) is 1/1 or higher and 3/1 or lower.

5. The toner according to claim 1, wherein the toner has a core-shell structure; and the core comprises a styrene-acrylic resin, and the shell layer comprises an amorphous polyester resin.

6. The toner according to claim 5, wherein the amorphous polyester resin is a polyester resin obtained by polycondensation of a polyhydric alcohol and a polyvalent carboxylic acid; and 80% by mol or more of the polyhydric alcohol is a bisphenol A propylene oxide adduct having an average addition molar number of propylene oxide of 1.8 or more and 2.3 or less.

* * * * *